US010460714B1

(12) United States Patent
Koch et al.

(10) Patent No.: US 10,460,714 B1
(45) Date of Patent: Oct. 29, 2019

(54) BROADBAND ACOUSTIC ABSORBERS

(71) Applicant: United States of Americas as represented by the Administrator of NASA, Washington, DC (US)

(72) Inventors: Lisa Danielle Koch, Brunswick, OH (US); Michael G. Jones, Newport News, VA (US); Peter J. Bonacuse, Lakewood, OH (US); Christopher J. Miller, Rocky River, OH (US); J. Chris Johnston, Cleveland, OH (US); Maria A. Kuczmarski, Independence, OH (US)

(73) Assignee: United States of America as Represented by the Administrator of National Aeronautics and Space Administration, Washington, DC (US)

( * ) Notice: Subject to any disclaimer, the term of this patent is extended or adjusted under 35 U.S.C. 154(b) by 286 days.

(21) Appl. No.: 15/425,313

(22) Filed: Feb. 6, 2017

Related U.S. Application Data

(60) Provisional application No. 62/291,755, filed on Feb. 5, 2016, provisional application No. 62/291,765, filed on Feb. 5, 2016.

(51) Int. Cl.

| | |
|---|---|
| ***G10K 11/172*** | (2006.01) |
| ***G10K 11/02*** | (2006.01) |
| ***G10K 11/04*** | (2006.01) |
| ***G10K 11/168*** | (2006.01) |
| *G10K 11/16* | (2006.01) |

(52) U.S. Cl.
CPC ..... *G10K 11/168* (2013.01)

(58) Field of Classification Search
CPC .... G10K 11/168; G10K 11/172; G10K 11/02; G10K 11/025; G10K 11/04; G10K 11/16; G10K 11/002
See application file for complete search history.

(56) References Cited

U.S. PATENT DOCUMENTS 2,369,006 A * 2/1945 Banks ..... B63C 9/08 156/197
3,734,234 A 5/1973 Wirt
(Continued)

FOREIGN PATENT DOCUMENTS

DE 2457769 A1 * 6/1976 ..... E04B 1/82
DE 2163798 C2 * 11/1982 ..... F16F 7/10
FR 2311370 A1 * 12/1976 ..... B60R 13/0838

OTHER PUBLICATIONS

Ooldham D.J., Egan, C.A. and Cookson, R.D., Sustainable acoustic absorbers from the biomass, Applied Acoustics, vol. 72, No. 6, pp. 350-363 (2011.

*Primary Examiner* — Edgardo San Martin
(74) *Attorney, Agent, or Firm* — Robert H. Earp, III; William M. Johnson

(57) ABSTRACT

Broadband acoustic absorbers may be capable providing good absorption performance between 0 and 3,000 Hz, and particularly below 1,000 Hz. Reeds may be incorporated in a single layer, multiple layers, or bundles. Such broadband acoustic absorbers may be applied for acoustic absorption in aircraft, spacecraft, residential and commercial buildings, vehicles, industrial environments, wind tunnels, or any other suitable environment or application where noise reduction is desired.

18 Claims, 38 Drawing Sheets

(56) References Cited

U.S. PATENT DOCUMENTS 3,937,590 A 2/1976 Mani
4,035,535 A 7/1977 Taylor
4,130,175 A 12/1978 Hehmann
4,233,530 A * 11/1980 Mikoshiba ..... H03F 7/04 307/424
4,235,303 A * 11/1980 Dhoore ..... B64D 33/02 181/214
4,313,524 A 2/1982 Rose
4,373,608 A * 2/1983 Holmes ..... G10K 11/172 181/202
4,410,065 A 10/1983 Harvey
4,433,751 A * 2/1984 Bonneau ..... F02K 1/827 181/213
4,753,841 A * 6/1988 Noel ..... B29C 44/468 428/174
5,220,535 A * 6/1993 Brigham ..... B63G 8/39 367/1
5,459,291 A 10/1995 Haines et al.
5,777,947 A * 7/1998 Ahuja ..... A47H 23/08 181/256
5,824,973 A 10/1998 Haines et al.
6,598,701 B1 7/2003 Wood et al.
6,617,002 B2 9/2003 Wood
6,851,515 B2 * 2/2005 Dussac ..... B64C 1/40 181/284
6,977,109 B1 12/2005 Wood
7,320,739 B2 1/2008 Thompson, Jr. et al.
7,402,537 B1 7/2008 Lenda et al.
7,500,541 B2 3/2009 Schmidt et al.
7,520,369 B2 * 4/2009 Dravet ..... B64D 29/00 181/284
7,520,370 B2 * 4/2009 Gudim ..... E04B 1/8209 181/284
7,618,907 B2 11/2009 Tilton
7,686,132 B2 3/2010 Olson et al.
7,717,228 B2 * 5/2010 Boock ..... B64C 1/066 181/207
8,365,862 B2 2/2013 Coates et al.
8,474,572 B2 * 7/2013 de Lima ..... G01R 33/3854 181/207
8,534,419 B2 9/2013 Coates et al.
8,662,249 B2 * 3/2014 Nair ..... G10K 11/168 181/284
8,689,934 B2 * 4/2014 Nishio ..... F16L 55/02763 181/229
8,789,652 B2 * 7/2014 Swallowe ..... G10K 11/172 181/293
9,765,516 B2 * 9/2017 Van Dinther ..... G10K 11/172
9,818,393 B2 * 11/2017 Lagarrigue ..... G10K 11/172
2002/0166721 A1 * 11/2002 Monson ..... G10K 11/16 181/292
2007/0031246 A1 * 2/2007 Peng ..... F01D 21/045 415/173.1
2012/0247867 A1 * 10/2012 Yang ..... E04B 1/86 181/211

* cited by examiner

500

800

810

820

830

840

850

860

870

880

890

860

892

894

1200

1210

2000

2100

2200

2300

2400

2500

2600

2900

BROADBAND ACOUSTIC ABSORBERS

CROSS REFERENCE TO RELATED APPLICATION

This application claims the benefit of U.S. Provisional Patent Application Ser. Nos. 62/291,755 and 62/291,765, both filed on Feb. 5, 2016. The subject matter of these earlier-filed applications is hereby incorporated by reference in its entirety.

ORIGIN OF THE INVENTION

The invention described herein was made by employees of the United States Government and may be manufactured and used by or for the Government for Government purposes without the payment of any royalties thereon or therefore.

FIELD

The present invention generally pertains to absorbing sound, and more specifically, to broadband acoustic sound absorbers.

BACKGROUND

Noise can present an irritating, or even dangerous, problem in a variety of environments. For instance, noise in residences and commercial buildings can be irritating, whereas noise generated by aircraft engines and in certain industrial environments, for example, may even harm individuals inside the aircraft or proximate to the industrial equipment generating the noise. Noise from aircraft or industrial sites can also disturb or harm nearby communities.

In the context of aircraft engines, broadband acoustic absorbers are beneficial for reducing noise produced by aircraft engines. This may be an even more acute problem for aircraft engines with short inlet ducts, convoluted inlet ducts, or obstructed inlet ducts. Engines with short, convoluted, or obstructed inlet ducts may produce noise, possibly at frequencies below 1000 Hz, due to disturbances in the flow entering the engine.

To reduce the noise propagating from aircraft engines, a combination bulk absorber-honeycomb acoustic panel designed for the duct of an aircraft turbofan engine has previously been described in U.S. Pat. No. 4,235,303. This design alleges to use a perforate over honeycomb absorber coupled to a broadband noise suppressing bulk absorber material that can be generically described as a finely divided felted or woven material, either organic or inorganic, having a high space-to-solid material ratio. Suitable bulk absorber materials are listed as porous ceramics, goose down, steel wool, Kevlar, and Scotfelt™. Preferably, the bulk absorber material is capable of attenuating noise in the range of 50 to 10,000 Hz.

A number of challenges are described in U.S. Pat. No. 4,235,303. Primarily, the bulk absorber and honeycomb need to be protected from water, oil, and dirt contamination while simultaneously exposed to the incident sound wave. U.S. Pat. No. 4,235,303 allegedly overcomes these challenges by sandwiching the bulk absorber and a honeycomb within layers of perforate, which allows liquid contaminants to drain in an effort to protect the acoustic panel and maintain adequate acoustic performance of the bulk absorber and honeycomb.

Another problem with bulk absorbers is that as the layers become thinner, as in an attempt to minimize weight and volume required for installation, the acoustic absorption coefficient decreases particularly at the lower frequencies, such that it generally remains a challenge to absorb sound with thin lightweight bulk absorbers at frequencies below 1,000 Hz. The honeycomb panels of U.S. Pat. No. 4,235,303, with large open pores arranged perpendicular to the direction of airflow through the engine, are typically used to reduce sound for a narrow range of frequencies, and that frequency range is dependent upon the depth of the channel.

It generally remains a challenge to absorb sound below 1,000 Hz with thin, lightweight honeycomb-like materials as well, given the typical space constraints and the requirement to survive in the harsh operating environment of an aircraft engine, and indeed in the 400-3,000 Hz frequency range generally. Accordingly, improved acoustic absorbers may be beneficial.

SUMMARY

Certain embodiments of the present invention may be implemented and provide solutions to the problems and needs in the art that have not yet been fully solved by conventional acoustic absorption technologies. For example, some embodiments of the present invention pertain to broadband acoustic absorbers capable of absorbing sound over a broad range. For instance, some embodiments may absorb sound over the 400-3,000 Hz range.

In an embodiment, an apparatus includes acoustic absorber panels located on a plurality of sides of a body to be acoustically dampened. Each acoustic absorber panel includes an acoustic absorber layer including natural reeds, synthetic reeds, or a combination of natural and synthetic reeds.

In another embodiment, an acoustic absorber panel includes an acoustic absorber layer including natural reeds, synthetic reeds, or a combination of natural and synthetic reeds, and a porous or perforated face sheet positioned on one or more sides of the acoustic absorber layer.

In yet another embodiment, a broadband acoustic absorber panel includes an acoustic absorber layer and a porous, hydrophobic, and/or oleophobic membrane positioned on at least one side of the acoustic absorber layer. The acoustic absorber layer includes a natural or synthetic bulk absorber, natural reeds, synthetic reeds, or any combination thereof.

BRIEF DESCRIPTION OF THE DRAWINGS

In order that the advantages of certain embodiments of the invention will be readily understood, a more particular description of the invention briefly described above will be rendered by reference to specific embodiments that are illustrated in the appended drawings. While it should be understood that these drawings depict only typical embodiments of the invention and are not therefore to be considered to be limiting of its scope, the invention will be described and explained with additional specificity and detail through the use of the accompanying drawings, in which:

FIGS. 8A-D include natural reeds, whereas FIG. 8E includes acrylonitrile styrene acrylate (ASA) reeds.

DETAILED DESCRIPTION OF THE EMBODIMENTS

Some embodiments of the present invention pertain to broadband acoustic absorbers capable of absorbing sound over a broad range. In some embodiments, reeds are incorporated in a single layer, multiple layers, or bundles. As used herein, the term "reed" may refer to any suitable elongated shape without deviating from the scope of the invention. Indeed, reeds may be hollow, solid, porous, bent, straight, have varying widths, fixed, free, have a "C" shaped cross-section, have a spiral cross section, have other cross-section shapes, the cross section shape may vary along the length of a reed, members may be arranged parallel to each other in layers, multiple layers may have different orientations relative to each other, layers may be arranged in bundles, each layer may include members with different shapes, layers may include any desired number of members, members in a layer may or may not touch each other, members in a layer may partially touch, etc. Members may increase and decrease at various points along their length (e.g., wider to thinner back to wider any desired number of times) in some embodiments.

Figure 29:
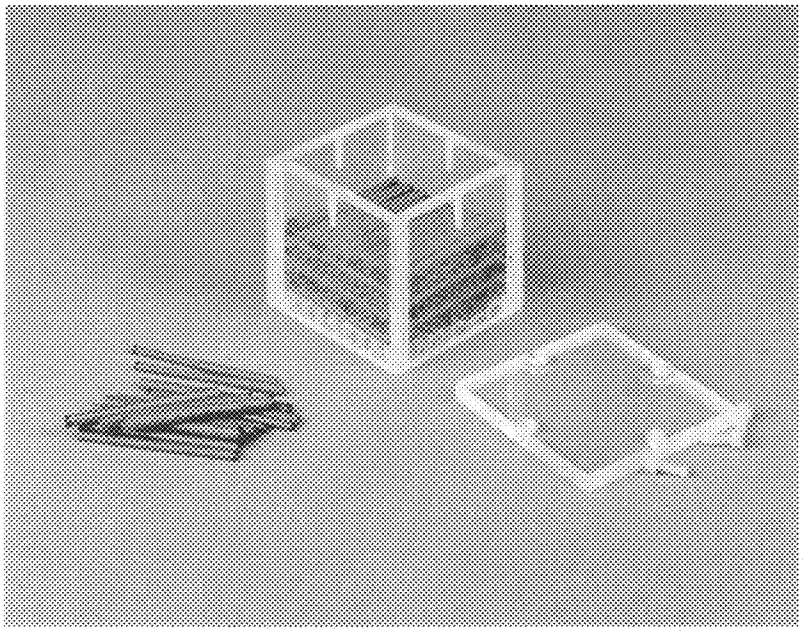
FIG. 29 is a perspective view illustrating an experimental ASA sample with "reeds" arranged in multiple layers with different orientations, according to an embodiment of the present invention.

In some embodiments, a single layer of reeds is used including substantially parallel members. In other embodiments, singles of layers of reeds are positioned in a multi-layer configuration, and different layers may have different sizes and/or orientations (see, for example, prototype 2900 of FIG. 29). For instance, one layer of reeds may be ⅜" whereas another is ¼". Additionally or alternatively, bundles of reeds may be used. Reeds may be fixed, free floating, or in any other suitable configuration. In certain embodiments, a face sheet may cover the reeds. In some embodiments, reeds may or may not have slits. In certain embodiments, at least some reeds may be graded where the thickness changes through a single layer (e.g., reeds may be tapered from ⅜" down to ¼" in a single layer). There may be some gaps between reeds in a layer in some embodiments.

Natural reeds are not well-suited for many applications, so synthetic structures were designed that mimic the structure of natural reeds in some embodiments. Plastic reeds generally mimicking the natural reed hollow structure were used in some embodiments. While plastics are mentioned here, metals, ceramics, or any other suitable material may be used without deviating from the scope of the invention.

Some embodiments may be applied to industrial applications and operating environments that have harsh operating conditions. However, some embodiments may be used in less harsh environments, such a cabin liners, school buses, etc. Indeed, various embodiments may be applied for acoustic absorption in aircraft, spacecraft (cabin ventilation fans are often a dominant source of noise in spacecraft cabins), residential and commercial buildings (e.g., walls, cubicle partitions, gyms, soundproof chambers for practicing musical instruments, etc.), vehicles, industrial environments, wind tunnels, or any other suitable environment where noise reduction is desired without deviating from the scope of the invention. It should also be noted that some embodiments may be useful for both harsh and more benign applications. Some embodiments provide low frequency sound absorption. Such embodiments may be thin and lightweight to be more beneficial for aircraft, spacecraft, and/or vehicle applications, where weight, size, and exposure to liquids and/or high temperatures are significant concerns.

Figure 1:
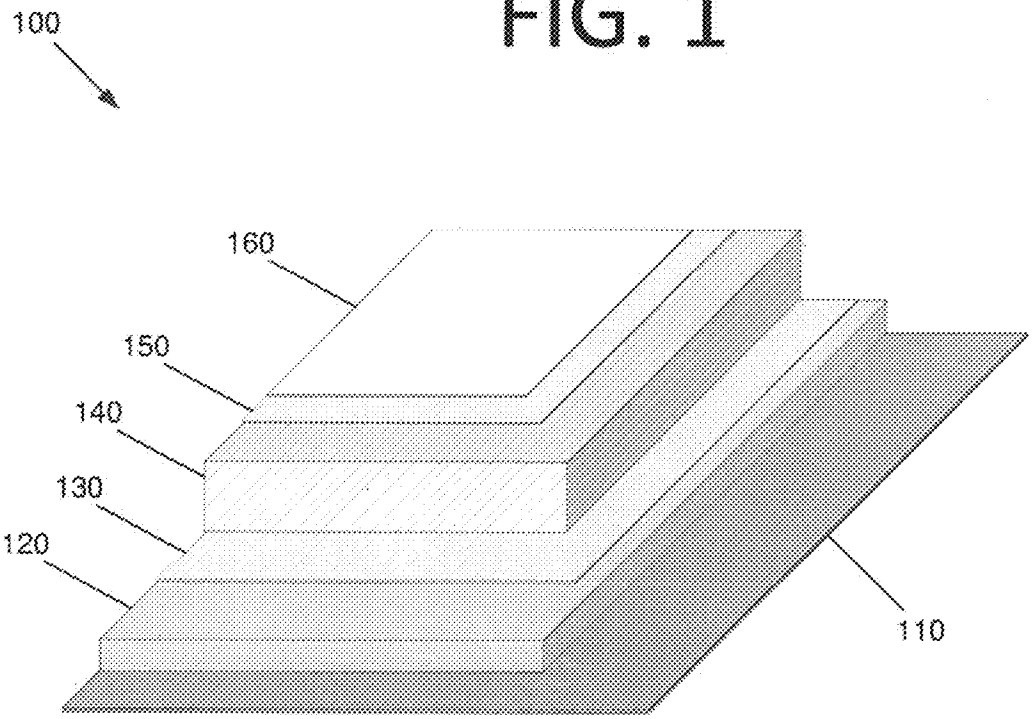
FIG. 1 is a side cutaway view illustrating an acoustic panel, according to an embodiment of the present invention.

FIG. 1 is a side cutaway view illustrating an acoustic panel 100, according to an embodiment of the present invention. Each successive layer is peeled away more so it is visible with respect to the other layers. Acoustic panel 100 includes a backing sheet 110, a bulk absorber 120 (e.g., Primaloft One™, which is a thin acoustic absorber that is particularly effective at frequencies above 1,000 Hz), and a high percentage open area screen 130 placed adjacent to bulk absorber 120 to prevent bulk absorber 120 from compressing, maintaining a depth that is beneficial for acoustic absorption. Acoustic panel 100 also includes a natural and/or synthetic reed layer 140, a and a porous, hydrophobic, and/or oleophobic membrane 150 (e.g., a GORE™ Acoustic Vent), and a porous cover sheet 160. Natural and/or synthetic reed layer 140 includes natural reeds and/or synthetic reeds that are arranged such that individual reeds are approximately parallel to each other and may or may not be covered by a porous face sheet.

Figure 2:
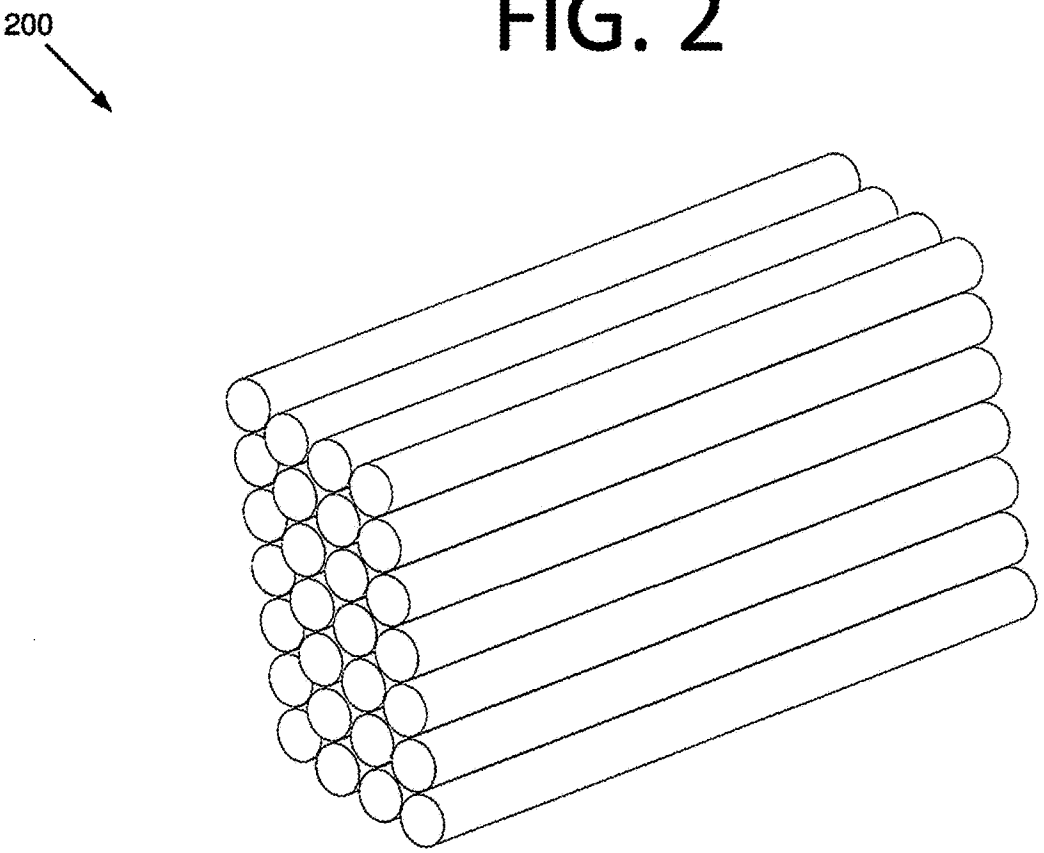
FIG. 2 is a perspective view illustrating multiple layers of reed structures, according to an embodiment of the present invention.

An example of multiple layers of reeds is shown in reeds 200 of FIG. 2. Such reeds may provide a lightweight, thin acoustic absorber that is particularly effective below 1,000 Hz. Membrane 150 may be added between porous cover sheet 160 and natural and/or synthetic reed layer 140 to protect both the reed assembly and bulk absorber 120 from contaminants while permitting incident sound waves to be transmitted and subsequently absorbed. In some embodiments, natural and/or synthetic reed layer 140 may be combined or augmented with a natural or synthetic bulk absorber. In some embodiments, membrane 150 may not be needed since acoustic panels are not normally exposed to liquid contaminants in various applications.

Figure 3:
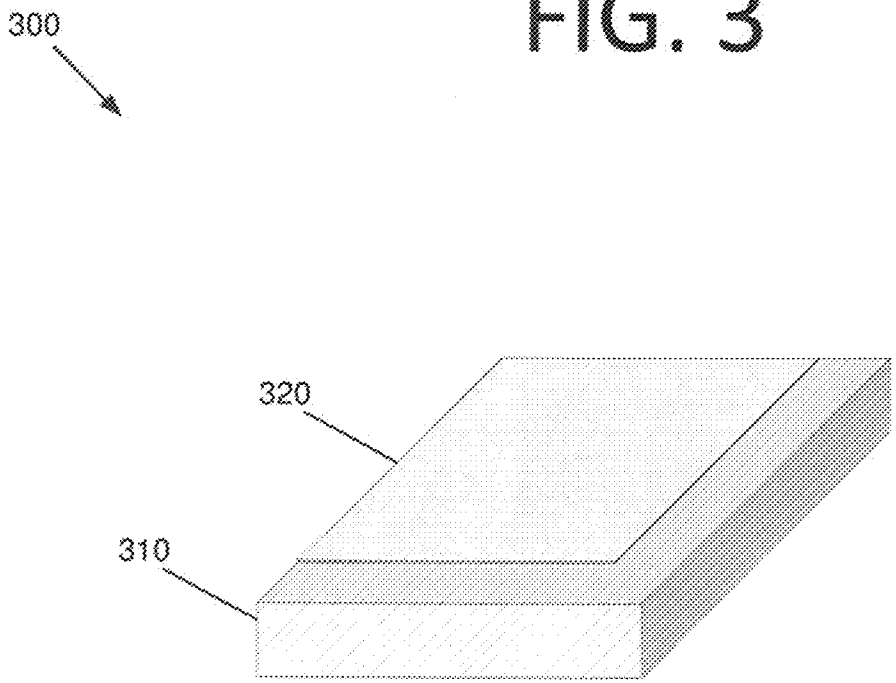
FIG. 3 is a side cutaway view illustrating an acoustic panel, according to an embodiment of the present invention.
Figure 4A:
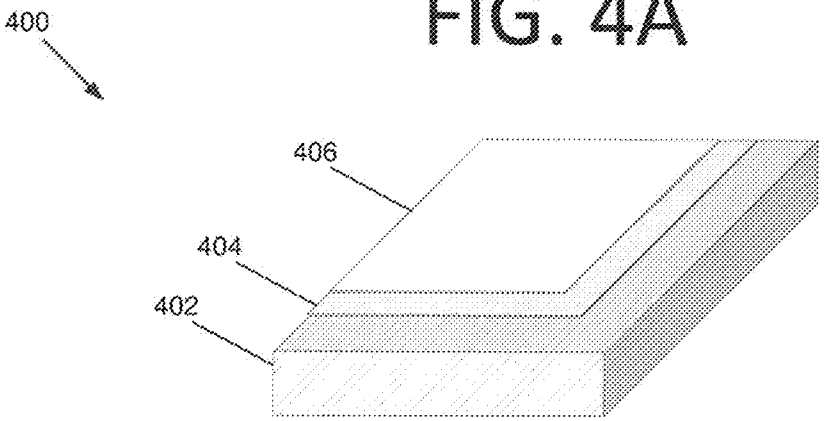
FIG. 4A is a side cutaway view illustrating an acoustic panel, according to an embodiment of the present invention.
Figure 4B:
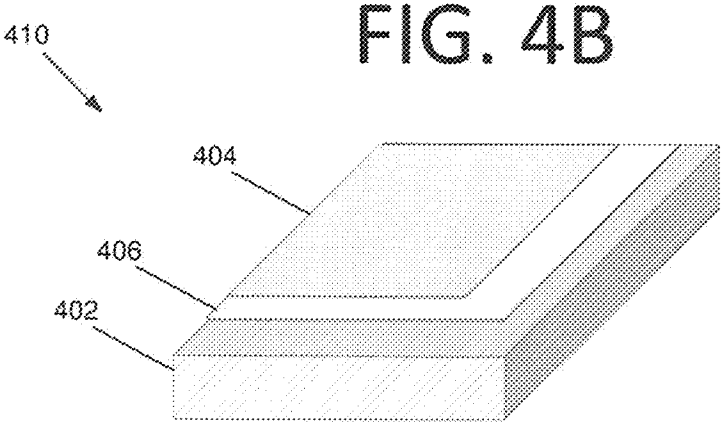
FIG. 4B is a side cutaway view illustrating an acoustic panel, according to an embodiment of the present invention.
Figure 5:
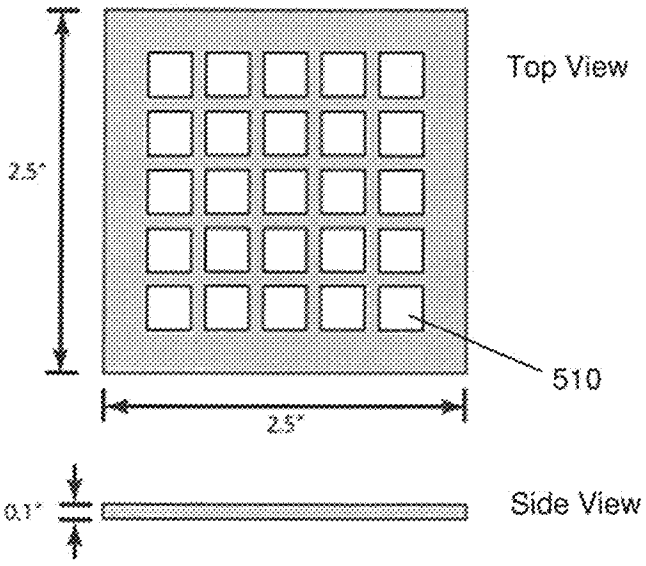
FIG. 5 illustrates top and side views of a notional porous or perforated face sheet, according to an embodiment of the present invention.

FIG. 3 is a side cutaway view illustrating an acoustic panel 300, according to an embodiment of the present invention. Unlike acoustic panel 100 of FIG. 1, acoustic panel 300 only includes two layers—a layer of natural and/or synthetic reeds 310 and a perforated face sheet 320. FIGS. 4A and 4B show alternative acoustic panels 400,410, respectively. Acoustic panel 400 includes a broadband acoustic absorber layer 402 (e.g., goose down, fiberglass, layered woven fabric such a Kevlar™, natural reeds, and/or synthetic reeds). A GORE™ Acoustic Vent 404 is located above acoustic absorber layer 402, and a perforated face sheet 406 is located above GORE™ Acoustic Vent 404. Acoustic panel 410 is similar to acoustic panel 400, but the locations of perforated face sheet 406 and GORE™ Acoustic Vent 404 are reversed. Top and side views of a notional porous or perforated face sheet 500 are shown in FIG. 5. Porous or perforated face sheet 500 includes "perforations" (or openings) 510 that allow sound to pass through to an absorber layer below. While the openings are shown here as being square in shape, the openings may be circular, rectangular, or any other suitable shape without deviating from the scope of the invention.

Figure 6:
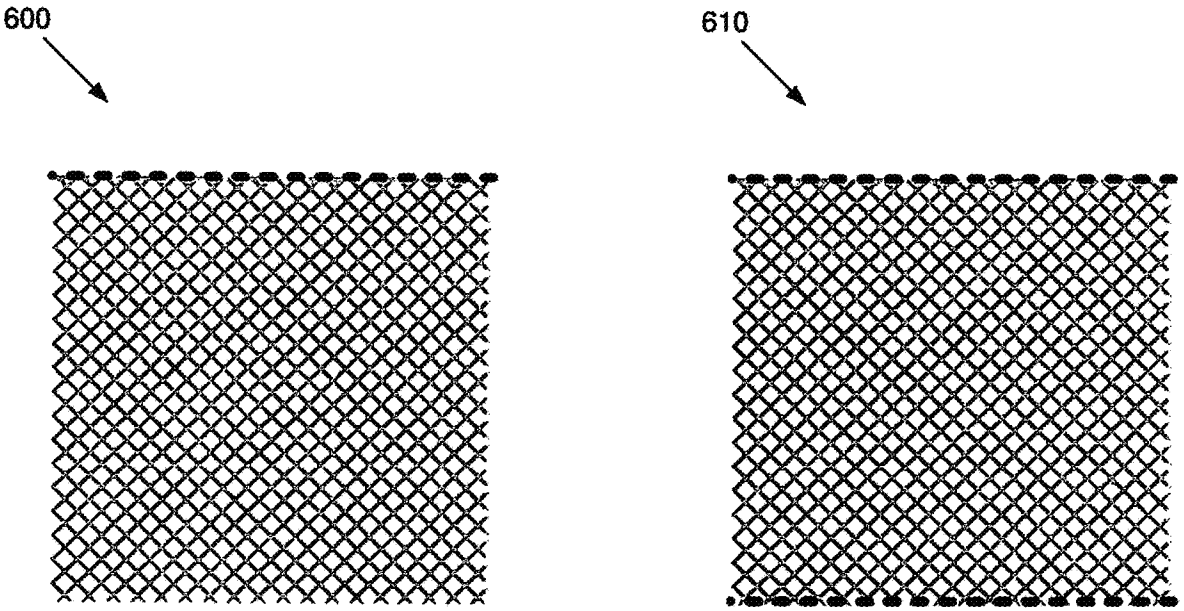
FIG. 6 is a cutaway view illustrating porous or perforated face sheets and membranes on either side of an absorber layer, according to an embodiment of the present invention.

FIG. 6 shows a single side configuration 600 and a two-sided configuration 610. Furthermore, in some embodiments, different sides have different types of panels. For instance, one side may use acoustic panels 400 of FIG. 4A and another side may use acoustic panels 410 of FIG. 4B.

Figure 7:
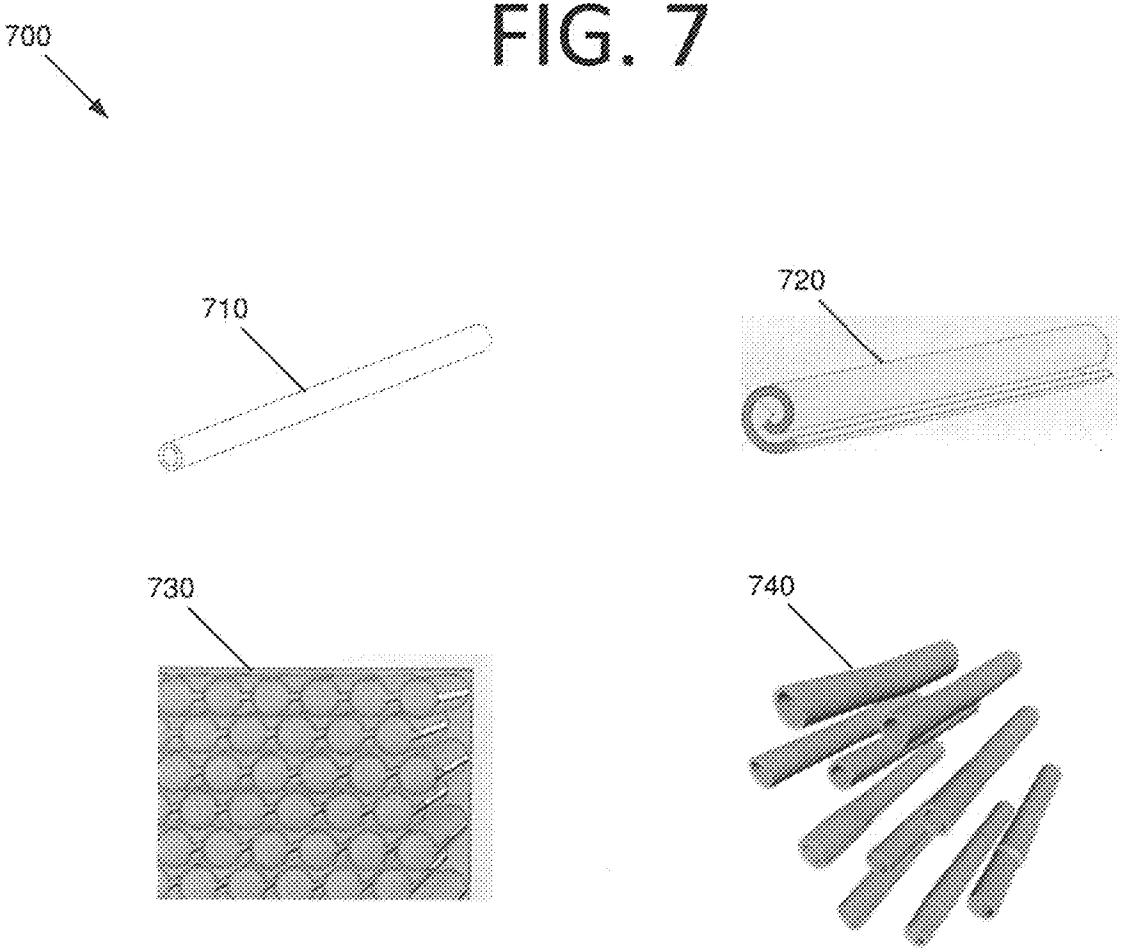
FIG. 7 illustrates various reed shapes, according to an embodiment of the present invention.

FIG. 7 illustrates various reed shapes 700, according to an embodiment of the present invention. For instance, reed 710 has a tube shape, reed 720 has a "C" shape, reeds 730 have a spiral shape, and reeds 740 have different shapes and widths. However, any suitable shape or shapes may be used without deviating from the scope of the invention.

Experiments Testing Acoustic Absorption Properties of Natural and Synthetic Reeds NASA additively manufactured structures from ASA thermoplastic that mimic the geometry and the low frequency acoustic absorption of assemblies of natural reeds, *Phragmites australis*. Results indicate that ASA structures can be built that exhibit acoustic absorption coefficients greater than 0.6 from 400 to 3,000 Hz. Results support the hypothesis that the macroscopic porosity of the structures is one important contributor to its performance as an acoustic absorber. The experiments demonstrate that a new class of structures may be considered for a wide range of industrial, commercial, residential, and aerospace products that would benefit from thin, lightweight, broadband acoustic absorption effective at frequencies below 1,000 Hz. Aircraft engine acoustic liners and aircraft cabin acoustic liners, for instance, are two aviation applications that may benefit from some embodiments.

Four samples of natural reeds, *Phragmites australis*, were tested in the NASA Langley and Glenn Normal Incidence Impedance Tubes in order to experimentally determine the acoustic absorption coefficients as a function of frequency from 400 to 3000 Hz. Six samples that mimicked the geometry of the assemblies of natural reeds were designed and additively manufactured from acrylonitrile styrene acrylate (ASA—also called acrylic styrene acrylonitrile) thermoplastic. The additively manufactured samples were also tested in both the NASA Glenn and Langley Normal Incidence Impedance Tubes. Comparisons were made between the acoustic performance of the samples made from natural and synthetic materials. Results indicate that structures can be manufactured of synthetic materials that mimic the geometry and the low frequency acoustic absorption of natural reeds.

In the context of considering sustainable materials for civil engineering noise control applications, it was observed by Oldham et al. that bundles of natural reeds, *Phragmites australis*, with depths of approximately 5 cm (2"), can absorb sound effectively at frequencies below 1,000 Hz. See Oldham, D J., Egan, C. A. and Cookson, R. D., *Sustainable acoustic absorbers from the biomass*, Applied Acoustics, Vol. 72, No. 6, pp. 350-363 (2011). This is the same frequency range and depth of interest for many aircraft noise control applications. These experiments were repeated at NASA Langley in 2014 with results that were similar, but not an exact match to the original findings. The differences have largely been attributed to the differences in the samples of natural reeds.

Per the above, natural reeds are an unsuitable choice of material for noise control in many commercial products. Accordingly, experiments conducted at NASA Glenn and Langley in 2015 to 2016 have demonstrated that it is possible to construct structures from a synthetic material that mimic the acoustic absorption of natural reeds. Experiments at NASA in 2015 and 2016 also reproduced the previous results for the acoustic absorption of natural reeds.

In short, NASA experimentally determined the acoustic absorption of ten samples using the NASA Glenn and Langley Normal Incidence Tubes. Four samples were constructed of natural reeds, and six samples were additively manufactured from ASA thermoplastic using Fused Deposition Modeling. To design and manufacture the plastic prototypes, porosity and tortuosity of the samples were calculated, beginning an attempt to quantify the differences between the samples and understand the physics of the interaction between structure and sound. Efforts have begun to identify physics-based models that could be used to calculate the acoustic absorption of these structures.

Acoustic measurements are compared from two liners: (1) a double degree of freedom (DDOF) perforate over honeycomb liner that was 38.1 mm (1.5") deep; and (2) a 50.8 mm (2") deep melamine foam that had a density of 0.6 kg/m$^3$. The DDOF liner was designed to absorb sound primarily at frequencies above 1,000 Hz. Melamine foam is used as a material to absorb unwanted sound in many industrial applications. Results support the hypothesis that the macroscopic porosity of the natural and synthetic reeds is one important contributor to the performance as an acoustic absorber.

Ten samples were constructed, as shown in FIGS. 8A-J. Five samples, 800, 810, 820, 830, 840, included multiple parts that were packed within a retainer, shown in FIGS. 8A-E, and five samples, 850, 860, 870, 880, 890, included a single part that did not require a retainer to hold its shape, shown in FIGS. 8F-J. The samples were made of two different types of materials. Four samples 800, 810, 820, 830 shown in FIGS. 8A-D and 8K were made of dried natural reeds, *Phragmites australis*. Six samples, shown in FIGS. 8E-J, were additively manufactured at NASA Glenn from ASA thermoplastic using a Stratasys Forms® 400mc Fused Deposition Modeler.

The retainers shown in FIGS. 8A-E and 8L were constructed of 635 mm (0.25") thick acrylic sheets. The front of the retainer was made of Nomex® honeycomb (5.70 mm, or 0.225"), and the acrylic backplate of the retainer was held in place with four glass reinforced nylon screws. These materials were chosen so that the retainers could be used to hold these samples in both the NASA Glenn and Langley Normal Incidence Impedance Tubes and the NASA Glenn X-Ray Computed Tomography (CT) scan machine, which included an Xray WorX XWT-225-SE™ x-ray source, a Dexela 2923™ flat panel Solid State CCD area detector, and NSI™ data acquisition and reconstruction software. The density of the acrylic, Nomex®, and nylon was close enough to the density of the *Phragmites australis* and the ASA thermoplastic that the resulting CT scan images were clear enough to see the macroscopic distribution of voids within and in between the natural reed and synthetic reeds.

Figure 8A:
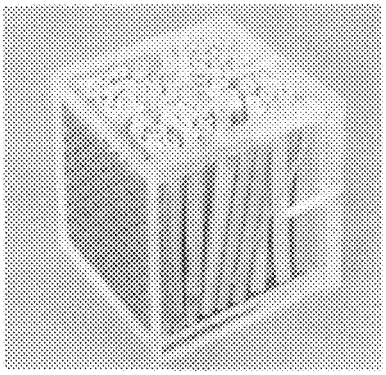
FIGS. 8A-E are side perspective views illustrating different experimental samples that include many parts held together within a retainer, according to an embodiment of the present invention.
Figure 8B:
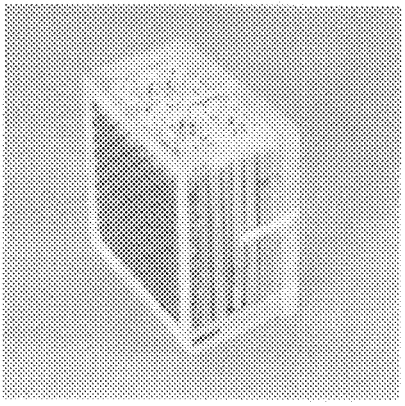
Figure 8C:
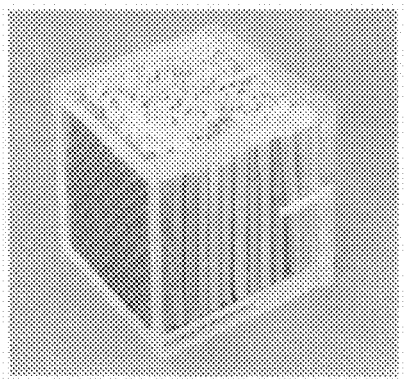
Figure 8D:
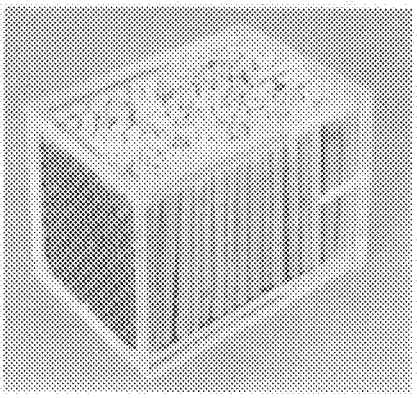
Figure 8E:
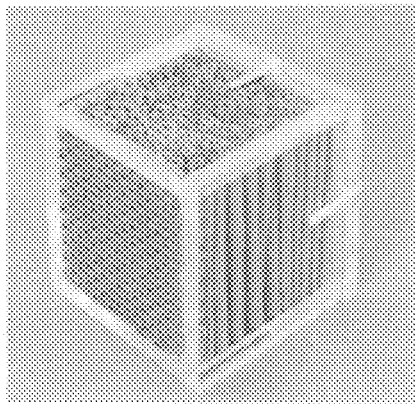
Figure 8F:
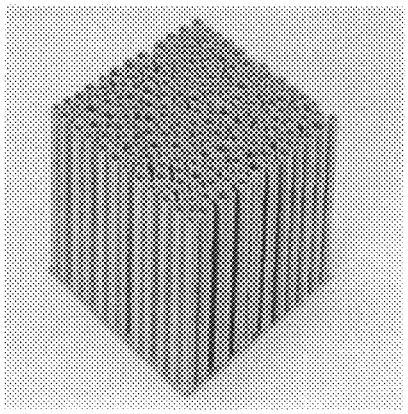
FIGS. 8F-J are side perspective views illustrating different experimental ASA samples that include a single part that do not need a retainer to maintain shape, according to an embodiment of the present invention.
Figure 8G:
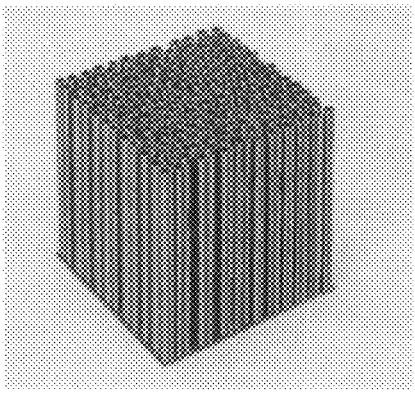
Figure 8H:
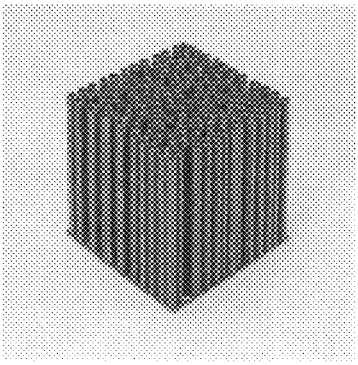
Figure 8I:
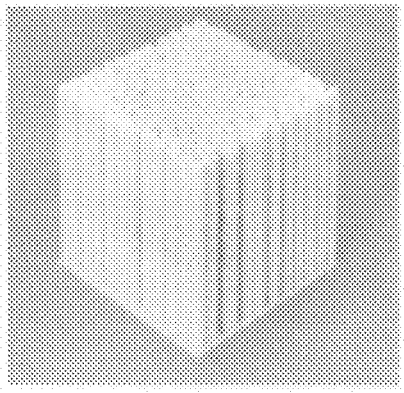
Figure 8J:
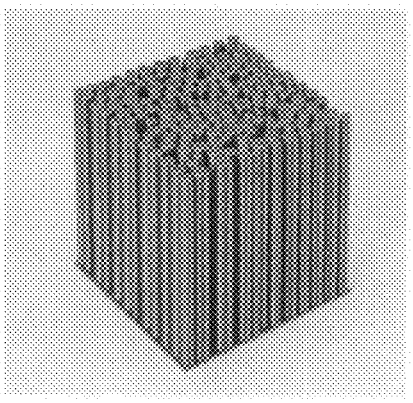
Figure 8K:
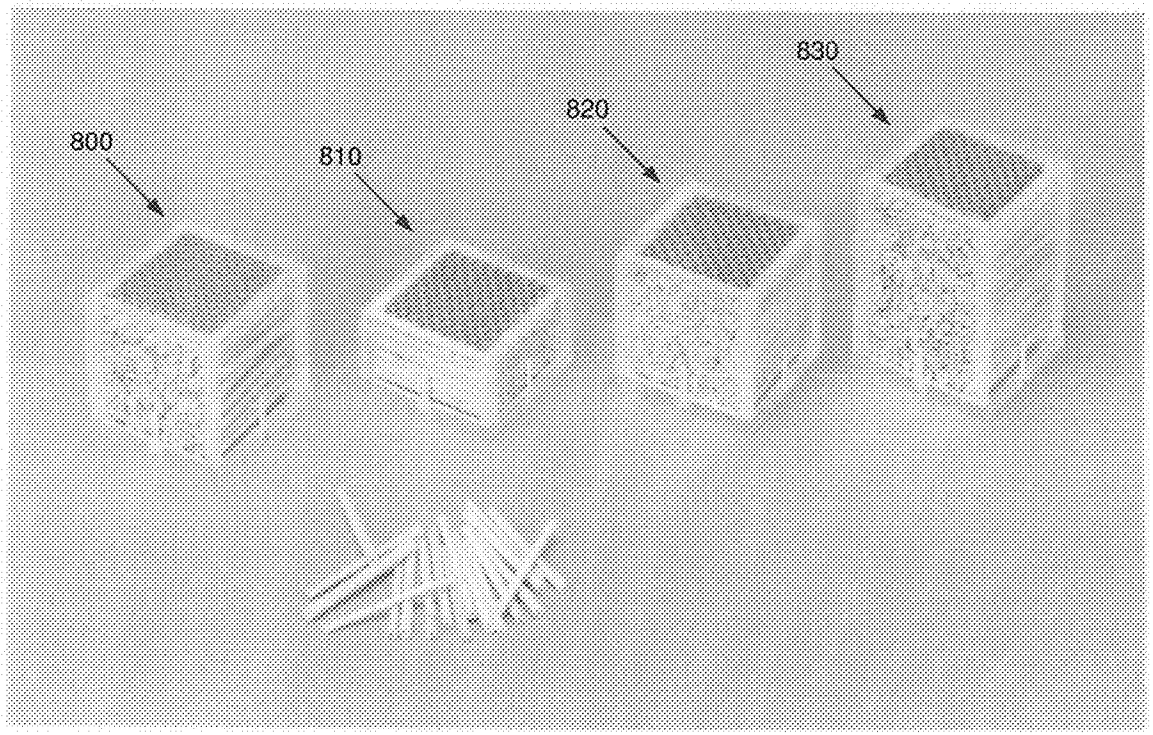
FIG. 8K shows the natural reed samples of FIGS. 8A-D together, according to an embodiment of the present invention.
Figure 8L:
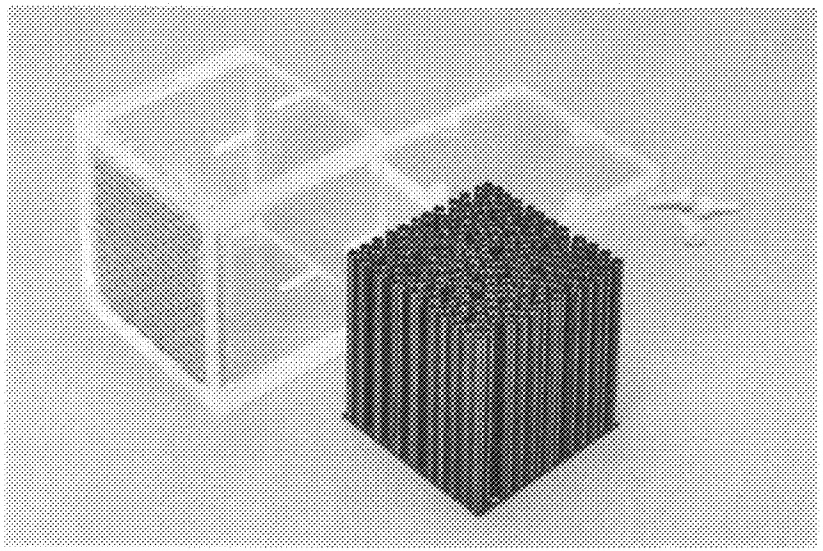
FIG. 8L shows the sample of FIG. 8G removed from its container, according to an embodiment of the present invention.

Four prototypes were constructed with *Phragmites australis*, shown in FIG. 8K described in Tables 1 to 3 below.

TABLE 1

NATURAL REED SAMPLES TESTED IN 2014

| Sample: | Cavity Depth, cm (in.) | Reeds in Sample | Sample mass, g |
|---|---|---|---|
| R12 | 5.08 (2.00) | 94 | 22.1 |

TABLE 1-continued

NATURAL REED SAMPLES TESTED IN 2014

| Sample: | Cavity Depth, cm (in.) | Reeds in Sample | Sample mass, g |
|---|---|---|---|
| R21 | 2.54 (1.00) | 64 | 12.6 |
| R22 | 5.08 (2.00) | 120 | 24.5 |
| R23 | 7.62 (3.00) | 168 | 33.7 |

TABLE 2

REPACKED SAMPLES TESTED IN 2015-2016

| Sample: | Cavity Depth, cm (in.) | Reeds in Sample | Sample mass, g |
|---|---|---|---|
| R12-repack (FIG. 1A) | 5.08 (2.00) | 88 | ~19.9 |
| R21-repack (FIG. 1B) | 2.54 (1.00) | 65 | ~12.5 |
| R22-repack (FIG. 1C) | 5.08 (2.00) | 120 | ~24.5 |
| R23-repack (FIG. 1D) | 7.62 (3.00) | 167 | ~33.7 |

TABLE 3

ARTIFICIAL REED SAMPLES TESTED IN 2016

| Sample: | Cavity Depth, cm (in.) | Reeds in Sample | Sample mass, g |
|---|---|---|---|
| ASA-2.0 (FIG. 1E) | 5.08 (2.00) | 184 | ~31 |
| ASA-2.1 (FIG. 1F) | 5.0292 (1.980) | 186 | 29.9 |
| ASA-2.2 (FIG. 1G) | 5.0292 (1.980) | 186 (design) | 29.7 |
| | | 185 (tested) | 29.7 |
| ASA-2.3 (FIG. 1H) | 5.0292 (1.980) | 170 | 27.5 |
| ASA-2.4 (FIG. 1I) | 5.0292 (1.980) | 186 | 77.9 |
| ASA-2.5 (FIG. 1J) | 5.0292 (1.980) | 170 | 72.6 |

The samples that were tested at NASA Langley in 2014 (Table 1) were repacked inside acrylic sample holders. Since the natural reeds were irregular shapes, not all of the reeds fit inside the sample holder when the samples were repacked. Samples R12-repack, R21-repack, and R23-repack contained fewer reeds than the original sets. Attempts were made to fit as many of the reeds from the original samples into the new holders as possible. To accomplish this, the ends of some of the reeds needed to be sanded down to reduce the length so they would fit snugly within the new sample holders. None of the reeds in R12-repack were sanded, though, and the packing in this sample was more irregular, leaving larger voids between the reeds than the original set R12. Masses for the repacked samples are approximate, calculated by subtracting the mass of any leftover reeds that did not fit into the sample holder from the original sample mass. Experimentally determined values of acoustic absorption of some of the natural reeds compared to baselines are shown in graph 900 of FIG. 9.

Six CT scans were obtained—one for each of the five "loose" samples shown in FIGS. 8A-E and one for 10 individual natural reeds spaced apart from each other (not shown). The CT scans were used to record the image of the macroscopic three-dimensional geometry of the samples. CT scan images were used to analyze the structures and to design and manufacture replicas or variants. The process that was used to design and fabricate the six ASA samples shown in FIGS. 8E-J. The fabrication process is described below.

Step 1—Generate CT image of 10 natural reeds. Ten natural reeds were selected for CT imaging. The reeds were approximately 50 mm (2.0") long, had irregular cross-sections, and generally were not very straight. Seven reeds had internal septa. The ten natural reeds were not packed closely together. Instead, they were held in place within the imaging volume so there was roughly 10 mm (0.39") between them. The complete scan consisted of a stack of 2520 image files saved in Tagged Image File Format (*.tiff). Each pixel had an edge length of 135 μm (0.0135 mm) and the distance between each slice was the same as the pixel size. There was little contrast between the reed walls and the surrounding open space in the CT scan image originals.

Step 2—Generate a Stereolithography (STL) file from the set of CT images for 10 natural reeds. The CT scan from the images of the ten natural reeds obtained in Step 1 was used to create a three-dimensional model in the form of an STL format file that was suitable for fused deposition modeling. A Python script was written that converted the grayscale CT scan images into a set of binary (black-and-white) images representing only the reed walls and the air-filled voids between the reeds. An STL file was created defining the three-dimensional geometry of the reeds from the stack of binary images. The process is described in more detail below.

First, a computer program was developed to process the grayscale image stack. The program was written using the Python scripting language, and the SciPy, NumPy, and scikit-image libraries. The results of a CT scan typically consist of a stack of images that represent the geometry of the scanned article at equally spaced "slices." Since the resolution of the CT scanned images was higher than resolution of the Fortus® 400mc Fused Deposition Modeler, the computer program used a subset of the entire CT scan image set. The Stratasys Fortus® 400mc Fused Deposition Modeler had four nozzles that set values for build slice height: 0.1270 mm (0.0050"), 0.1778 mm (0.0070"), 0.2540 mm (0.0100"), and 0.3302 mm (0.0130").

The images were filtered, using an averaging filter with a Gaussian kernel, to attenuate the noise inherent in the x-ray imaging of low mass materials. The images were then "segmented," i.e., an algorithm was devised to decide which pixels were reed material and which pixels were voids. This was done by choosing a "threshold"—pixels equal to or brighter than the threshold represented reed material and pixels darker than the threshold intensity represented air. For this problem, a k-means clustering algorithm was utilized to determine the threshold value. The k-means algorithm was an iterative refinement approach that sorts the pixel intensities into groups that minimized the within group variances. Not only did this approach take the subjectivity out of the threshold choice, but it also tended to select a point midway between the "segments" in regions where there was a gradient (edges of the reeds, in this case).

The stack of thresholded images were then assembled into a three-dimensional array. The interiors of the reeds tended to be complex. The reed wall thicknesses were irregular, internal diameter shape was irregular, and there were septa (a wall separating chambers along the length of the reed). To reduce the complexity of the model, the centers of the reeds were "filled," turning them into solid rods using a multistep process (described below in the discussion of the porosity and tortuosity calculations). This thresholded and filled three-dimensional voxel map of the CT scanned reed geometry was then imported into Avizo™ 3D analysis software version 9.1 where the surface contours were mapped and a STL file was generated and output. To reduce the size and complexity of the resulting surface map, the open source MeshLab™ V1.33 software was used to simplify the model using a quadratic edge collapse decimation algorithm.

Figure 10:
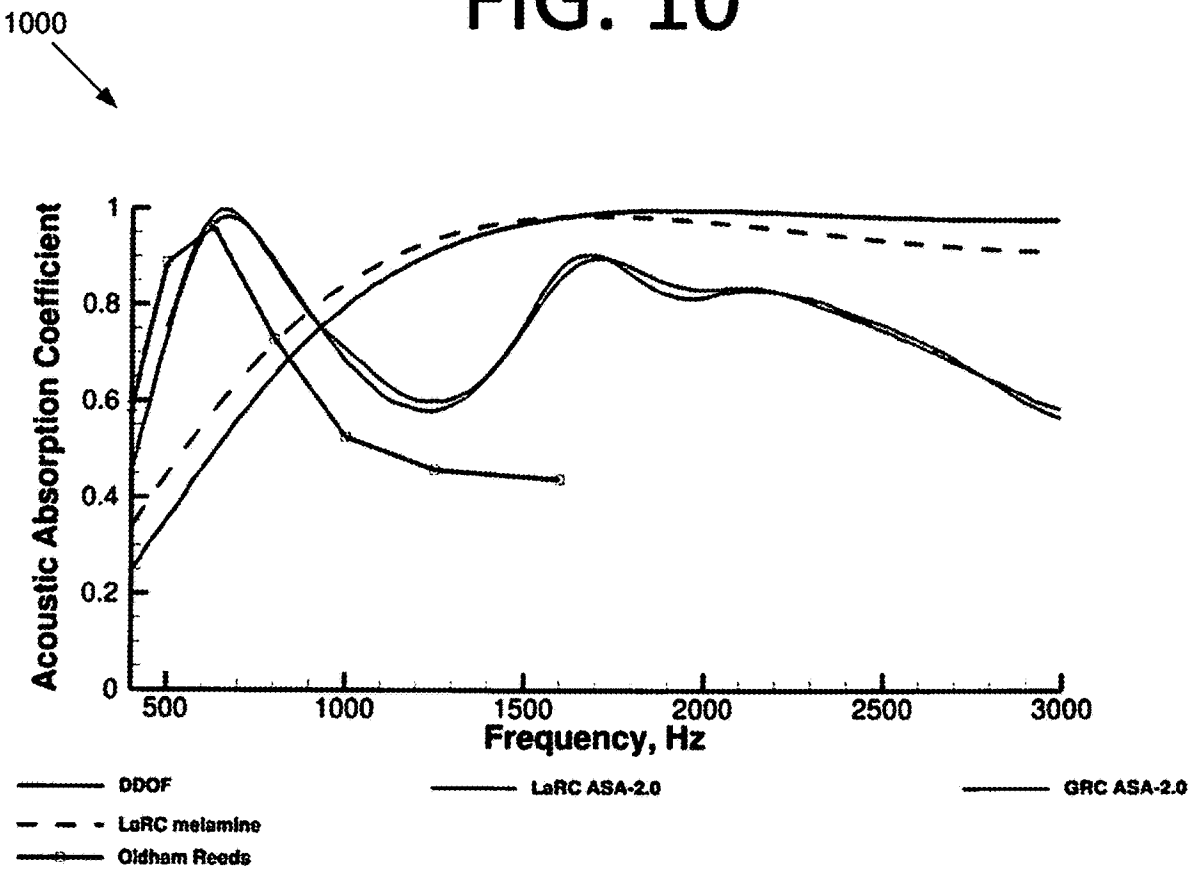
FIG. 10 is a graph illustrating ASA loose reed tubes packed in an acrylic sample holder, compared to baselines, with a broadband source providing 140 dB overall sound pressure level (OASPL), according to an embodiment of the present invention.

Given that the resolution of the CT scanned images is higher than the additive manufacturing technology could possibly reproduce, the spatial resolution of the final models was significantly down-sampled from the original scans. This was a significant accomplishment in the development of this concept. It was the first printable STL that represented the irregular cross-sections of the natural reeds that allowed building of a replica of the assembly from a synthetic material. The acoustic tests of ASA-2.0 demonstrated for the first time that the acoustic absorption coefficient for this "loose" configuration of irregular tubes manufactured from ASA thermoplastic was also greater than the baselines at frequencies below 1,000 Hz, as shown in graph 1000 of FIG. 10, similar to what had been observed previously with a natural material.

Step 3—Modify and print STL file using Fused Deposition Modeling. The STL file for the configuration "10-unpacked" created in Step 2 was used as input to Insight™ (Version 10.1), the software package used to prepare jobs and control the Stratasys Fortus® 400mc Fused Deposition Modeler. The STL file contained 19,010 facets. Once the STL file was read into Insight™, it was scaled in the lengthwise direction from 33.9115 to 50.1396 mm (1.9740") so that the end gaps within the 50.8 mm (2.00") wide acrylic sample holder were minimized. Next, Insight™ was used to slice the STL geometry, creating contours on the surface of the reed model. Using Insight's editing tools, the irregular rods were converted to tubes by offsetting a new contour inwards 030 mm (0.020") from the original. The contour width (0.3556 mm, 0.0140") was set to be twice the slice height (0.1778 mm, 0.0070"). The STL was scaled so that the resulting length was an integer multiple of one of the Fortus® 400mc factory preset slice heights.

Toolpaths for the support material required at the base of these irregular tubes were calculated, and toolpaths for the ASA thermoplastic were calculated. Multiple copies of these synthetic reeds were printed on Fortus® 400mc. Support material was removed from the final parts by rinsing with water in an ultrasonic bath. The loose ASA reeds were packed within a 50.8 mm (2.00") deep acrylic sample holder to create sample ASA-2.0. See FIG. 8E.

Step 4—Generate CT image for ASA-2.0. A CT scan was obtained for ASA-2.0.

Step 5—Create an STL file for ASA-2.1 from one image of ASA-2.0 CT scan. A CT scan image from a single cross-sectional plane of sample ASA-2.0 was converted from a low-contrast grey-scale image to a modified black-and-white image using Adobe Illustrator™ and GIMP image processing software packages. The black-and-white image was manually modified in several ways: the acrylic sample holder and Nomex® honeycomb were removed from the image and a gap was provided around each ASA reed. The assembly of natural reeds is a highly irregular three-dimensional geometry, with reeds occasionally touching their neighbors. The assembly of loose synthetic reeds in sample ASA-2.0 is also an irregular three-dimensional geometry, with synthetic reeds occasionally touching their neighbors, though it is less porous and irregular than the *Phragmites*

*australis*. Gaps were added around each curve defining the reed shapes on the two-dimensional template so that none of the synthetic reeds would be fully connected to any of their neighbors in the full three-dimensional extrusion.

The single cleaned-up high contrast image from one plane of the ASA-2.0 sample was used as a template to design ASA-2.1, which consists of a single part and does not require a retainer to maintain its shape. The black-and-white image was imported into Solidworks™ 2015 and used as a template. Solidworks™ 2015's Autotrace™ add-in was used to create curves to approximate the irregular cross-sectional outer surface of the ASA reeds in sample ASA-2.0. New curves were created to represent the reed inner surface. Wall thickness for the resulting tubes was set to be a constant value of 0.3556 mm (0.0140"), a choice made to be compatible with the settings of the Forms® 4.00 mc. The two-dimensional curves were extruded to make a single 3D part, with a baseplate (of four slice thickness equal to 0.7112 mm) to hold the reeds in position relative to each other.

Circular holes were manually designed into the baseplate so that ends of the ASA-2.1 sample were open, mimicking the geometry of the natural reeds. Two additional tubes were manually added to the design to fill a gap near one wall, which were not present in the fully three-dimensional ASA-2.0, but would have been an undesirable end gap in an extruded design. The resulting design was saved in the STL file format required as input for the Fused Deposition Modeler.

This step was significant step forward in the concept development process. This was the first time a printable STL was obtained that represented irregular two-dimensional cross-sections and the irregular relative orientation of the tubes. The acoustic tests of ASA-2.1 demonstrated for the first time that the acoustic absorption coefficient for this "fixed" configuration was also greater than the perforate over honeycomb and melamine baselines at frequencies below 1,000 Hz. This finding may be of practical importance, as "fixed" configurations may be preferred to "loose" configurations for different industrial applications. The ability to design and fabricate prototypes that were "fixed" was also an important step forward as it enables more controlled experiments so researchers can begin to understand the physics of the interaction between sound and these irregular structures.

Step 6—Prepare and print the STL for ASA-2.1 using Fused Deposition Modeling. The STL file for sample ASA-2.1 created in Step 5 was then prepared for printing using the Insight™ software. The STL file was first opened in the Insight™ software, and the geometry was divided or sliced into layers needed for the fused deposition modeling process. Toolpaths were generated for the support material and the ASA thermoplastic. The part was then printed, as shown in FIG. 8F.

Step 7—Create STLs for ASA-2.2, 2.3, 2.4, 2.5 using Solidworks™. ASA-2.2, ASA-23, ASA-2.4, and ASA-2.5 (FIGS. 8G-J) were all derived from the design of ASA-2.1 (FIG. 8F). The design process for each of these prototypes is described separately below. At this point in the concept development, the team was exploring the capabilities of the printer and identifying and overcoming design challenges.

For ASA-2.2, a baseplate of thickness 0.7112 mm (0.0280") was generated. The tube shape is the same Solidworks™ 2015 using the Autotrace™ add-in discussed above. The curves were used to cut holes in the baseplate, and to extrude thin walled 0.3556 mm (0.0140") tubes to fit in the baseplate holes. Using this process eliminated the need for the circular holes used in ASA-2.1. The entire sample consists of 186 tubes, 78 of which are full length (50.1396 mm, 1.9740") and are colored red. Some tubes (108 of 186) were randomly selected to be two layers, 0.3556 mm (0.0140"), shorter than the others.

For ASA-2.3, following the design process for ASA-2.2, the tube shape was created, the shape was used to cut holes in the baseplate, and then thin walled tubes were generated for all but sixteen tubes. These sixteen tubes were randomly chosen to be removed from the design, so that this entire sample ASA-2.3 consists of 170 tubes. All the holes in the baseplate remained, even though the tubes were removed from the design.

For ASA-2.4, following the design process for ASA-2.1, the auto-traced curves were used to extrude solid rods attached to the baseplate. This sample consisted of 186 solid rods. The rods were the same shape and same orientation as the tubes of ASA-2.1.

For ASA-2.5, using the model of ASA-2.4, the rods were removed from the same sixteen locations in ASA-2.3 where tubes were removed. Note that the baseplate is solid in the locations where the rods are removed. The entire design consists of 170 rods.

Step 8—Prepare and print the STL files for ASA-2.2 through ASA-25 using Fused Deposition Modeling. The STL files created in Step 7 were prepared for printing using the Insight™ software. Each STL file was input into the Insight™ software. Each design was then divided into layers needed for this additive manufacturing process. Toolpaths were generated for the support material and the ASA thermoplastic. The parts were printed, as shown in FIGS. 8G-J.

ASA-2.7 was a three-dimensional model of the reed geometry that was generated from a CT scan of the ASA-2.0 additive manufactured reeds using the methodology described above. Because the edges of the reeds were not well-defined (noisy, low contrast images), and the noise filtering tends blur the image, there was often some overlap in the pixel intensities where the reeds were in close proximity to one another. This made it appear that the reeds were "glued" together where they touched in the thresholded model.

To correct for this, a watershed separation algorithm was employed. This required that the reeds first be turned into solid rods through a series of operations. After assembling the stack of thresholded images into a three-dimensional array, the acrylic box enclosing the reeds was removed by oriented it with Cartesian axes and then cropping the array to include just the packed reeds. The ends of the reeds were then cropped an additional amount to eliminate the often split and broken ends thereof. The empty spaces around and within the reeds was then quantified and the spaces within the reeds filled. The watershed separation algorithm was then applied and a one pixel gap was enforced between the reeds. To obtain a model with hollow reeds with uniform wall thickness, three dimensional morphological and Boolean operations were performed. Uniform erosion of a model copy by an amount equivalent to the desired wall thickness was performed and then XORed to the solid reed model. This thresholded and separated three-dimensional voxel map of the CT scanned reed geometry was then imported into the Avizo™ software where the surface contours were mapped and a STL file was generated and output.

Figure 8M:
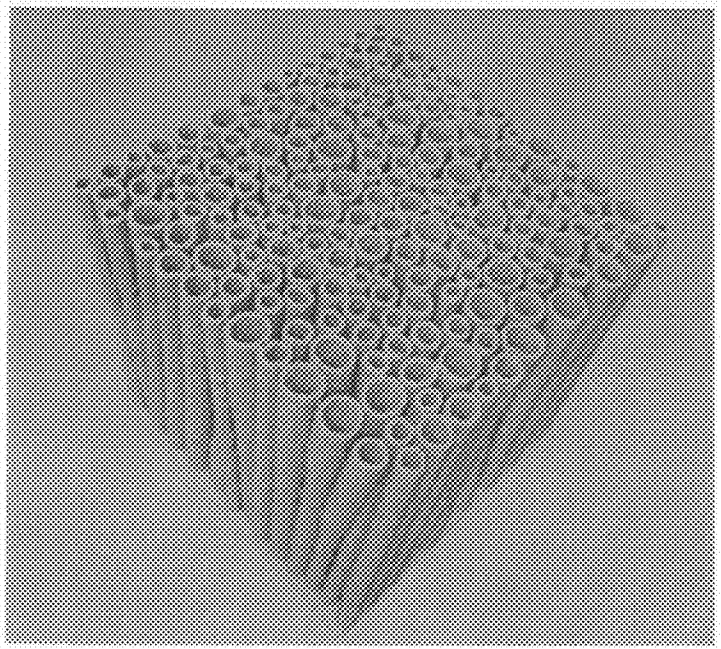
FIG. 8M is a model of ASA-2.7 including reeds with hollow ends, according to an embodiment of the present invention.
Figure 8N:
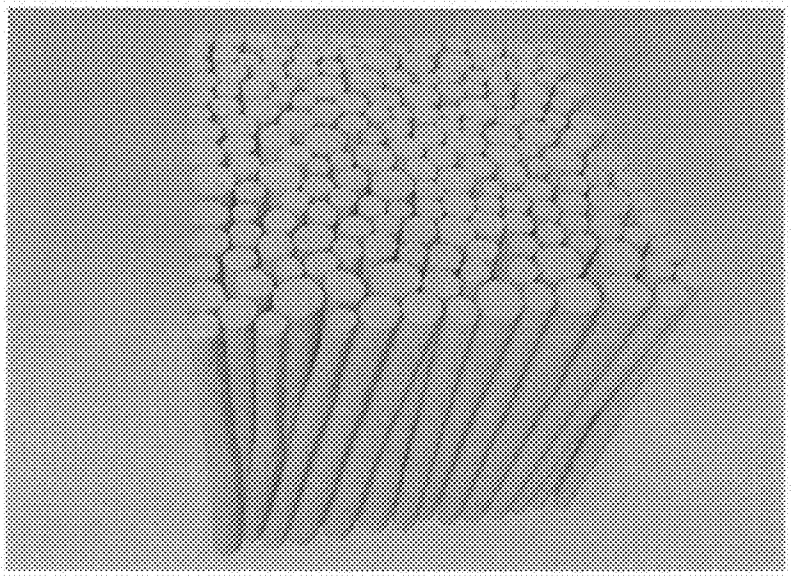
FIG. 8N is a model of ASA-2.7 including reeds with solid ends, according to an embodiment of the present invention.

To reduce the size and complexity of the resulting surface map, the open source MeshLab software was used to simplify the model using a quadratic edge collapse decimation algorithm. A baseplate was added to the STL of the three-dimensional model of the reeds, which fixed the position of the reeds. See models 892, 894 of FIGS. 8M and 8N. This was a significant accomplishment because fully three-dimensional prototypes that fix the position of individual reeds in an assembly can be used for more controlled tests needed to understand the interaction of sound with the structure and develop physics-based models of the phenomena.

To try to correlate the observed (or designed) geometry of the natural and artificial reeds and the sound absorption performance, characteristics of the open space surrounding the reeds (pore space) were quantified. Several parameters that influence the pore space were relatively easy to calculate: the number of reeds, their size distribution, and the pore space volume fraction. Measuring the tortuosity of the sound propagation path around the reeds took somewhat more effort.

Figure 11:
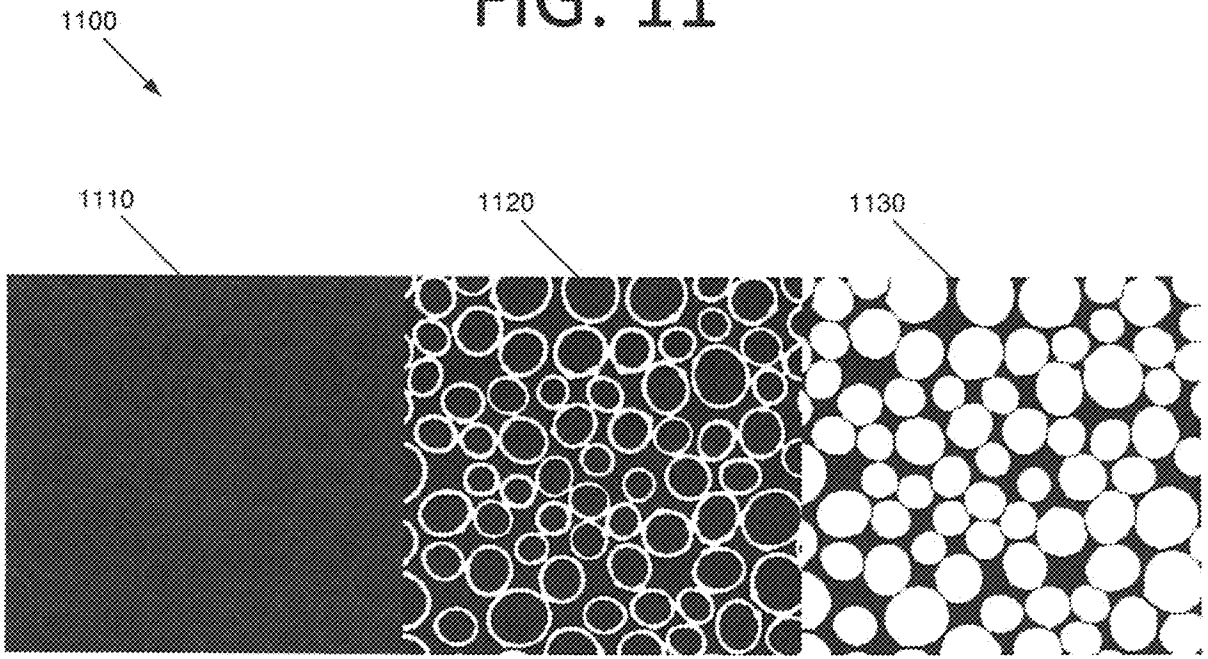
FIG. 11 illustrates images from a process for turning reeds into solid rods, according to an embodiment of the present invention.

Because edges of the reeds were not well defined (the images were noisy, had poor contrast and the noise filtering tended to blur the image), there was often some overlap in the pixel intensities where the reeds were in close proximity with one another. To correct for this, a watershed separation algorithm was employed. This required that the images of the thin-walled hollow reeds first be turned into images of solid rods through a series of operations. An illustration of this process is shown in images 1100 of FIG. 11. More specifically, left image 1110 shows the original CT scan, center image 1120 shows the binary image after threshold, and right image 1130 shows the filled and watershed separated image of ASA-2.0.

First, the stack of binary images was assembled into a three-dimensional array and the retaining box was cropped away. Next, the reed ends were cropped an additional amount to eliminate, as much as possible, the often split and broken ends of the reeds. The volumes of the empty spaces around and within the reeds were then quantified by counting the connected voxels and the relatively smaller spaces within the reeds were filled. Finally, the watershed algorithm was applied and a one-pixel gap was enforced between the reeds.

Because some of the natural reeds were split and broken along their entire length, the CT scans of these samples were particularly difficult to reconstruct. Therefore, spatial measurements and tortuosity calculations were performed on a representative section that was edited to digitally "repair" the broken reeds. Because of this, the porosity and tortuosity calculations for these samples must be considered approximate.

Tortuosity can be defined as the ratio of shortest path through the pore space, or geodesic distance, and the straight-line path, or Euclidian distance. By this definition, the tortuosity can be computed at any point within the pore space. An approach has been previously devised to determine the tortuosity distribution within the pore space of CT scanned sandstone. The approach involves performing a "flood fill" from a source location (a plane in this instance) and recording the number of steps at each increment of the moving flood front. Using this algorithm, a function was written in Python to perform this operation on the CT scans of the re-packed natural reeds (R12, R21, R22, and R23), the packed artificial reeds (ASA-2.0), and the fixed geometry models (ASA-2.1 through ASA-2.5).

Figure 12:
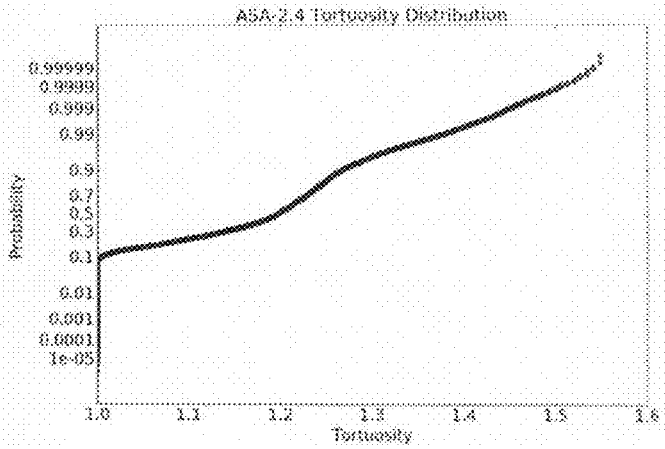
FIG. 12 includes a graph and an image illustrating the tortuosity probability distribution (sound entering at the bottom) for a slice through the ASA-2.4 model, according to an embodiment of the present invention.
Figure 12:
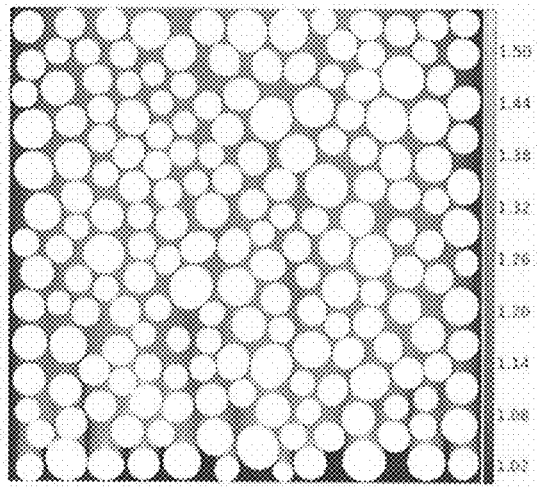

To describe the tortuosity of the pore space, some statistical parameters may be appropriate. In graph 1200 and image 1210 of FIG. 12, a plot of the tortuosity calculated for a slice through the ASA-2.4 model is shown. The tortuosity is not normally distributed (the rank order probability of a normal distribution plotted on a normal probability scale would be linear). There are many locations in the pore space, especially at the entrance and along the edges parallel to the sound propagation, where the tortuosity is very close to unity (darker areas of the plot). Therefore, parameters that would accurately describe a normal distribution (mean and standard deviation) are not entirely appropriate.

Tables 4 and 5 below displays statistics for each of the samples that were examined (CT scanned packed reeds R12, R21, R22, R23, and ASA-2.0, and models derived from the STL files used to make ASA-2.1 through ASA-2.5). These statistics include the number of reeds, mean values and standard deviations of the reed diameters, between reed open area volume fraction (porosity), and tortuosity statistics.

TABLE 4A

PORE SPACE AND REED SIZE DESCRIPTORS FOR THE NATURAL AND ARTIFICIAL REED PACKAGES

| Identifier | # Reeds | Between-Reed Porosity[d] | Reed Mean Diameter (mm) | Reed Diameter (SD) |
|---|---|---|---|---|
| CT Scans | | | | |
| R12-repack | 88 | 0.279 | 5.18 | 0.406 |
| R21-repack | 65 | 0.247 | 4.39 | 0.517 |
| R22-repack | 120 | 0.244 | 4.52 | 0.540 |
| R23-repack | 167 | 0.282 | 4.60 | 0.518 |
| ASA-2.0[a] | 184 | 0.314 | 3.48 | 0.554 |
| ASA-2.0[c] | | | | |
| Generated Models | | | | |
| ASA 2.1/2.4 | 186 | 0.349 | 3.35 | 0.537 |
| ASA 2.2[b] | 185 | 0.353 | 3.35 | 0.539 |
| ASA-2.3/2.5 | 170 | 0.394 | 3.38 | 0.545 |

TABLE 4B

PORE SPACE AND REED SIZE DESCRIPTORS FOR THE NATURAL AND ARTIFICIAL REED PACKAGES

| Identifier | Median Tortuosity | Tortuosity SD | Tortuosity at Opposite Face | Sound Enters From |
|---|---|---|---|---|
| CT Scans | | | | |
| R12-repack | 1.192 | 0.1101 | 1.193 | Right |
| R21-repack | 1.229 | 0.1618 | 1.244 | Top |
| R22-repack | 1.262 | 0.1453 | 1.223 | Right |
| R23-repack | 1.241 | 0.1218 | 1.158 | Top |
| ASA-2.0[a] | 1.205 | 0.1047 | 1.187 | Bottom |
| ASA-2.0[c] | 1.239 | 0.1132 | 1.247 | Bottom |
| Generated Models | | | | |
| ASA 2.1/2.4 | 1.196 | 0.0941 | 1.178 | Bottom |
| | 1.204 | 0.0895 | 1.173 | Right |
| ASA 2.2[b] | 1.195 | 0.0961 | 1.178 | Bottom |
| | 1.204 | 0.0911 | 1.174 | Right |
| ASA-2.3/2.5 | 1.175 | 0.0875 | 1.164 | Bottom |
| | 1.177 | 0.0812 | 1.158 | Right |

[a]Single slice tortuosity calculation for slice used to generate models ASA-2.1-5
[b]3D tortuosity calculation for entire volume of ASA-2.0
[c]One reed missing (broke off during handling)
[d]Voids inside the reeds were neglected in the porosity calculation To turn the models (STL files) used as the templates for the additive manufacturing of ASA-2.1 through ASA-2.5 into three-dimensional voxel maps for the tortuosity and porosity calculations, operations similar to those done on the CT scanned images were performed. Avizo™ software was used to convert the STL models into a stack of images that could then be turned into voxel maps with a pixel resolution similar to the CT scans.

Most of the tortuosity calculations were performed in two-dimensions only (flood fill in the plane of a single slice).

A three-dimensional tortuosity calculation was performed for the full reconstruction of the ASA 2.0 artificial packed reeds. A two-dimensional calculation was also performed on the slice from the ASA-2.0 CT scan that was used to construct the extruded models (ASA-2.1 through 23). At this point in the concept development, tools to calculate tortuosity and porosity were being developed. Now that tools exist to compute tortuosity and porosity for the prototypes, it is now possible to study the relationship between tortuosity, porosity, and acoustic absorption in more detail.

Acoustic Predictions

Engineers who are working towards optimizing the design of acoustic liners for turbofan engines are looking for simple models to characterize the acoustic impedance of different materials and structures. Much of the existing work in predicting acoustic properties for bulk absorbers are microstructural in nature, examining pores in the solid structure and the fluid that fills them. For such an approach, tortuosity may be included as a factor in a material's interaction with sound waves.

Models for predicting acoustical characterization of materials with a pore size variation at the microscopic level may not be applicable to biomass such as reeds, where the pores associated with such structures are relatively large. This could suggest an investigation of predictions using a macroscopic approach, such as examining the transfer of energy from the fluid to the reeds using boundary layer theory and dimensionless numbers used to characterize fluid flow and heat transfer. Looking to develop analogies between heat transfer and the transfer of acoustic energy, if possible, might provide light on predictions of acoustical performance of such materials.

Normal Incidence Tube Tests

Acoustic absorption was measured for these ten samples in two facilities: the NASA Glenn Normal Incidence Tube and the NASA Langley Normal Incidence Tube (NIT). The test apparatus and the test procedures differed slightly and will be described below. Historically, the NASA Langley NIT has been one facility used to vet acoustic liner concepts for NASA aircraft engine noise reduction research.

The normal incidence impedance apparatus used to make measurements at NASA Glenn is made of extruded aluminum tubing with a square cross-section. It is typically utilized with square samples mounted in sample holders that match the dimensions of the tube. Using this arrangement, the sample holders are trapped between the end of the tube and a relatively thick (3") reflective terminator, and none of the clamping pressure is borne by the sample itself.

In operation, the reflection coefficient of the sample is tested at a series of discrete frequencies, ranging from 500 to 3,600 Hz, typically in 25 Hz steps. Prior to data collection, the amplitude of the signal driving the sound source is adjusted at each of the test frequencies to deliver 105 dB at the microphone showing the most intense signal. The microphone preamps are adjusted at 1,000 Hz using a 94 dB signal from a microphone calibrator. That gives an amplitude value at a known intensity, allowing the calculation of the intensity at the tested level to ensure that the signal remains within the range of the microphones and data acquisition system. This adjustment, however, results in not applying the same sound pressure level to the sample at each test frequency. This should only have an adverse effect if the properties of the material under test change with the applied sound level.

The microphones are 101.6 mm (4.00") and 133.35 mm (5.25") away from the sample face. Those distances allow for measurable differences in the intensity of the standing wave produced due to sampling the intensity at different points in the waveform. The tube has a horizontal orientation.

The data collected from the microphones is processed to calculate the reflection ratio for the sample at each of the test frequencies. From the reflection ratio, the absorption coefficient and impedance can be calculated using procedure described in the relevant ISO and ASTM standards.

Test Results

The normal incidence tube of the NASA Langley Normal Incidence Tube is a waveguide that employs six 120 W compression drivers to generate a plane-wave sound field. The tube has a vertical orientation. This sound field impinges on the surface of the liner and combines with reflections from the liner to create a standing wave pattern. The Two-Microphone Method is used to measure the complex acoustic pressures at two prescribed distances from the liner surface, such that the frequency dependence of the acoustic impedance of the liner can be computed.

The Two-Microphone Method can be applied with two acoustic source types: discrete frequency tones and random noise. For the discrete frequency tone source, data are acquired for one source frequency at a time, typically for source frequencies from 400 to 3,000 Hz in increments of 200 Hz. At each test frequency, reference sound pressure levels (SPL at the reference microphone) of 120 and 140 dB are tested such that any liner nonlinearity (sensitivity to acoustic sound pressure level) can be assessed. For the random noise source, an overall sound pressure level (OASPL, integrated over frequency range of 400 to 3,000 Hz) is typically set to 120 or 140 dB, and data are acquired at frequencies from 400 to 3000 Hz in 25 Hz increments.

All of the prototypes were tested, and the plots for acoustic absorption versus frequency for each sample were determined, as shown in FIGS. 9, 10, and 13-26. Examining the NASA Langley 2016 broadband dataset, it was shown that there was very little difference measured between the 120 dB OASPL and the 140 OASPL conditions. When the 120 dB OASPL and the 140 dB OASPL datasets were compared, the average difference between the resistance measurements was calculated to be −0.011±0.157, the average difference between the reactance measurements was calculated to be −0.021±0.159, and the average difference between the acoustic absorption coefficients was calculated to be 0.006±0.020.

Examining the 2016 NASA Langley 140 dB OASPL dataset, it was shown that there was also very little difference measured between the tone and broadband data. When the tone and broadband datasets were compared, the average difference between the resistance measurements was calculated to be −0.024±0.092, the average difference between the reactance measurements was calculated to be 0.019±0.092, and the average difference between the acoustic absorption coefficients was calculated to be −0.003±0.018. Since these differences were small, only the broadband 140 dB OASPL dataset is shown in graphs 900, 1000, and 1300-2600 of FIGS. 9, 10, and 13-26, respectively.

Figure 9:
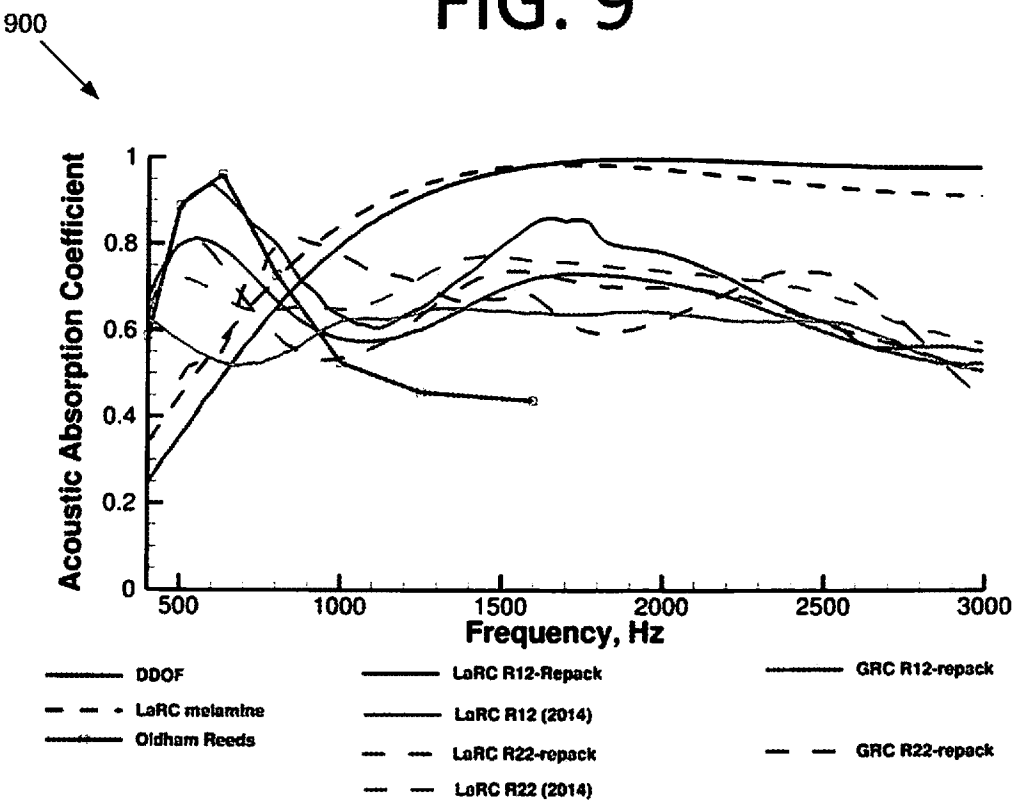
FIG. 9 is a graph illustrating experimentally determined values of acoustic absorption of some of the natural reeds compared to baselines, according to an embodiment of the present invention.
Figure 27:
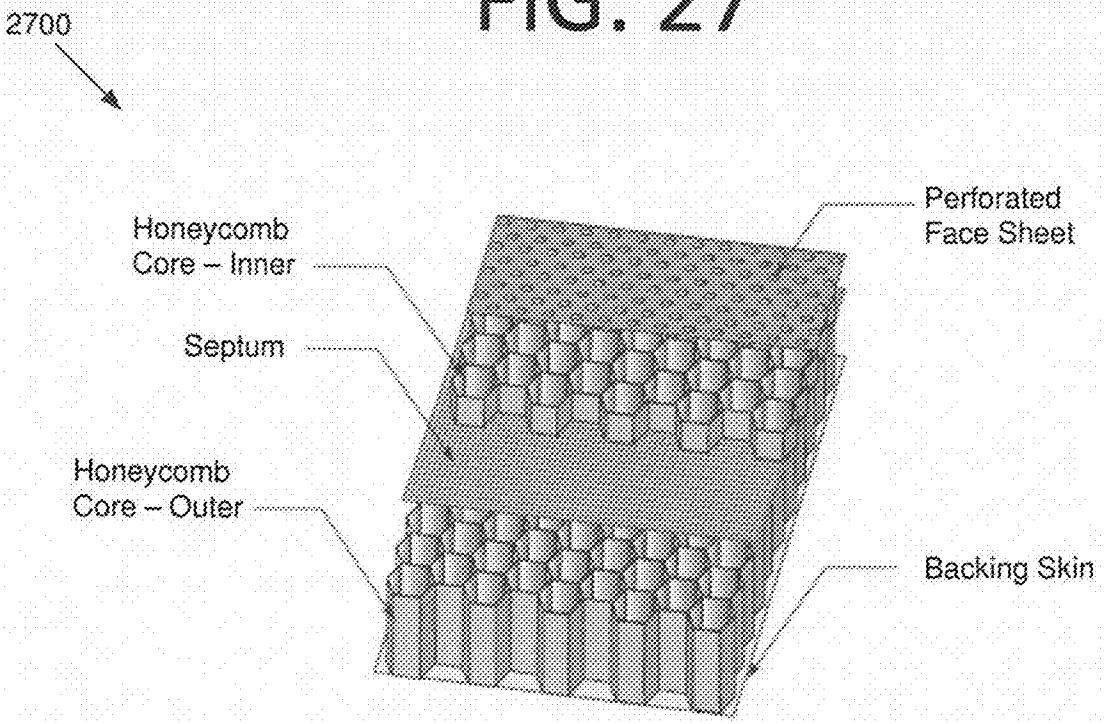
FIG. 27 is a cutaway perspective view illustrating a double degree of freedom (DDOF) Perforate-Over-Honeycomb turbofan engine acoustic duct liner.

The acoustic absorption of the natural reeds tested at NASA Langley in 2014 and in 2016 and at NASA Glenn in 2016 were compared with published results by Oldham et al. Graph 900 of FIG. 9 shows Oldham et al.'s results compared with the repacked natural reeds tested by NASA. A double degree of freedom (DDOF) perforate over honeycomb liner (see DDOF liner 2700 of FIG. 27) and melamine sample (not shown) are also plotted for comparison.

All samples in FIG. 9 were approximately 5.00 cm (2.00") deep. Again, differences between the samples of natural reeds tested at NASA are described in Tables 2 and 3. The primary differences between R12 and R12-repack are the number of reeds in the sample and the size and geometry of the interconnected voids between the reeds. Oldham et al.'s samples were tested in a normal incidence tube with a round cross-section, which made it difficult to fit the natural reeds snugly to the ends of the test section. One hypothesis is that the size and arrangement of voids of R12-repack sample more closely resembled the voids of Oldham et al.'s set resulting in similar acoustic absorption. More carefully controlled experiments may be beneficial to test this hypothesis, though.

The sample of *Phragmites australis* tested at NASA Glenn (GRC R12-repack) appeared to match the Oldham et al. data most closely, though when the same sample was subsequently shipped and tested at NASA Langley (LaRC R12-repack), results were slightly different. One reason for this difference could be that the loosely packed natural reeds shifted within the acrylic sample holder, changing the distribution of pores between the reeds. Controlled tests with the natural reeds are very difficult to perform since the material is fragile and reeds have been observed to break apart when handled. The acoustic absorption of all natural reed samples did exceed the acoustic absorption of the DDOF liner and the melamine at the lowest tested frequencies.

The acoustic tests of ASA-2.0 demonstrate for the first time that ASA thermoplastic is one synthetic material that can be used to build loosely packed groupings of synthetic reeds that exhibit acoustic absorption similar to that of assemblies of *Phragmites australis*, which can exceed 0.6 for frequencies below 1,000 Hz. This can be seen in graphs 1000 and 2100 of FIGS. 10 and 21, respectively, which includes test results from NASA Langley (LaRC) and NASA Glenn (GRC). The acoustic tests of ASA-2.0 demonstrate for the first time that the acoustic absorption of assemblies of loosely packed irregular tubes manufactured from ASA thermoplastic is greater than the double degree of freedom (DDOF) liner chosen as a baseline for these studies at frequencies below 1,000 Hz. The DDOF liner was a 38.1 mm (1.5") deep, two-layer liner with a wire mesh/perforate facesheet and an embedded mesh septum in each chamber. See FIG. 27.

The minimum acoustic absorption coefficient for ASA-2.0 between 500 and 2,875 Hz was 0.6, indicating high acoustic absorption over a wide range of frequencies. The ASA-2.0 sample did not include a wire mesh face sheet. The acoustic absorption of ASA-2.0 is also greater than the 50.8 mm (2.0") deep sample of melamine foam for frequencies ranging from 400 to 800 Hz.

Figure 13:
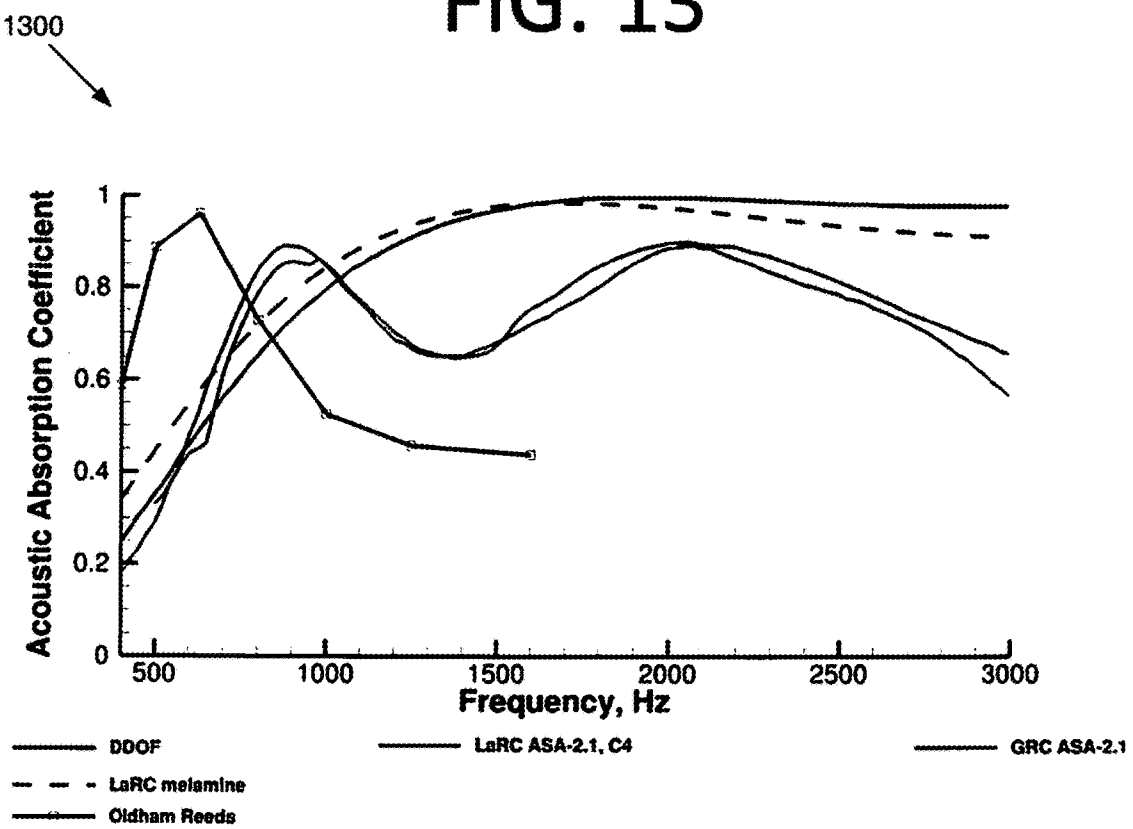
FIG. 13 is a graph illustrating experimentally determined values of the acoustic absorption of ASA-2.1, a prototype manufactured from ASA that does not need a retainer to hold its shape, compared to baselines with a broadband source providing 140 dB OASPL, according to an embodiment of the present invention.
Figure 22:
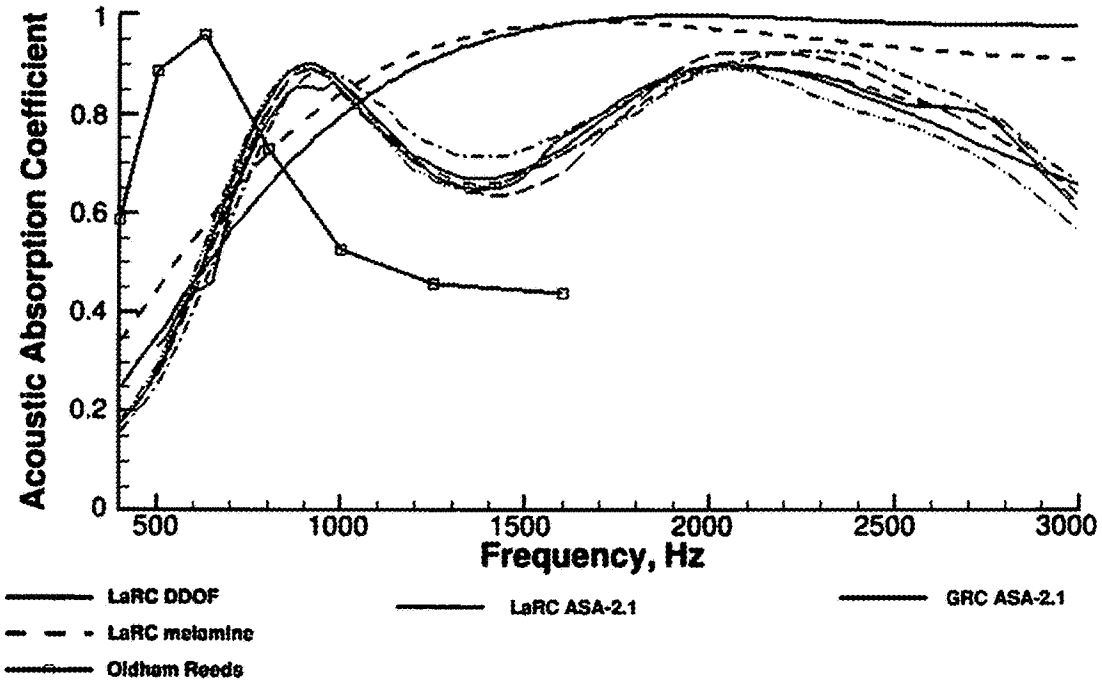
Figure 23:
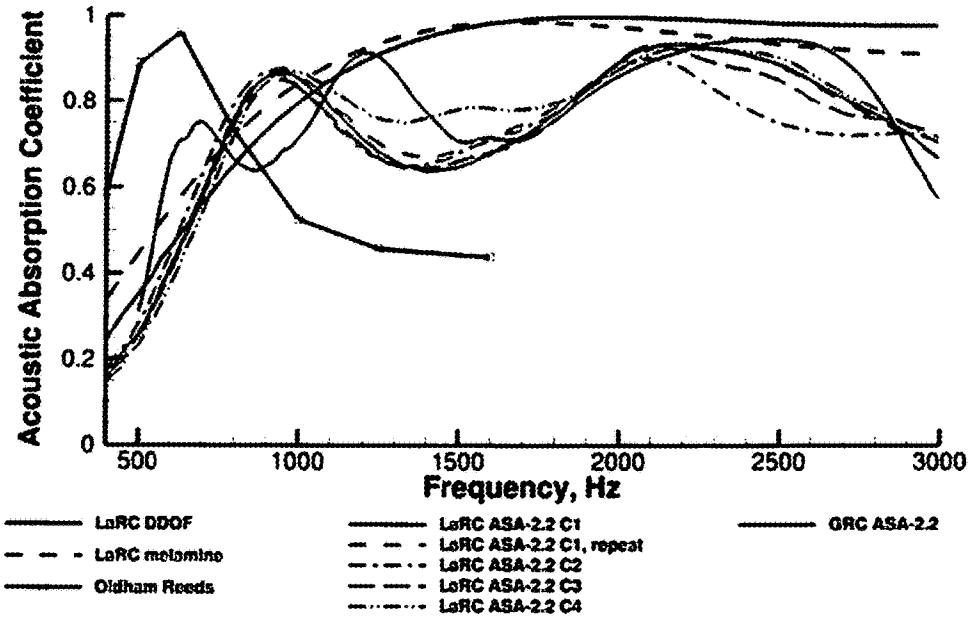
Figure 24:
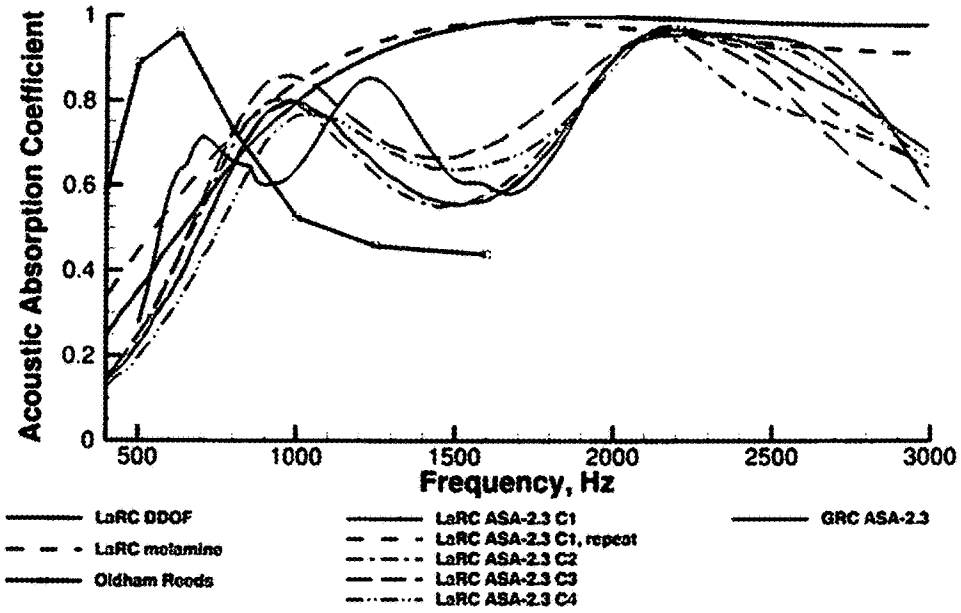
Figure 25:
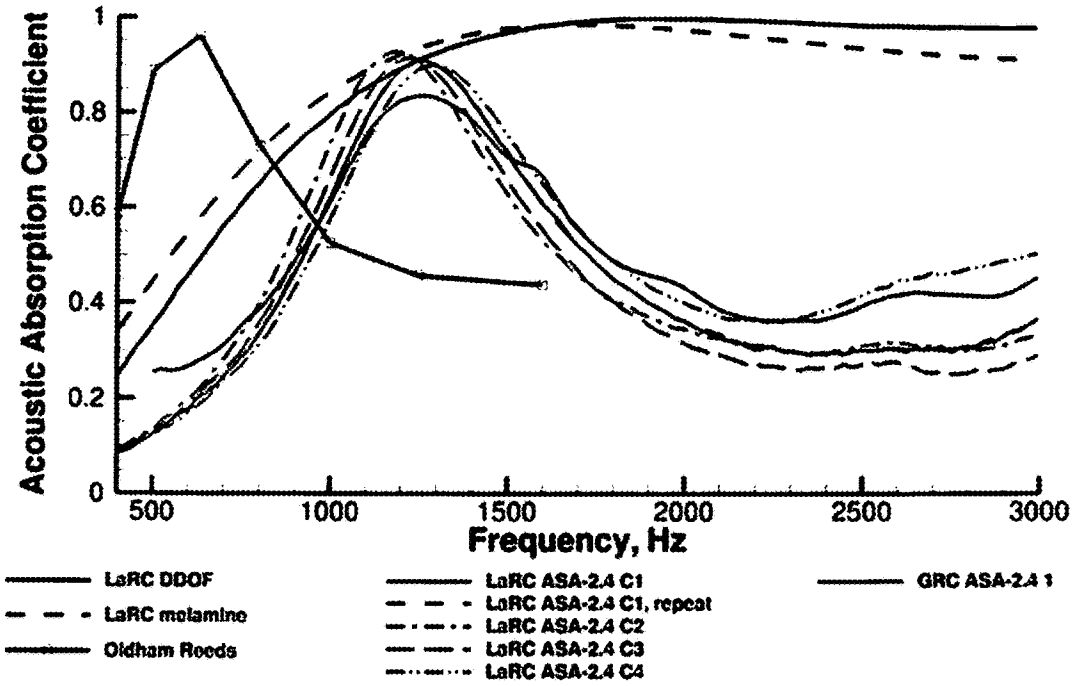
Figure 26:
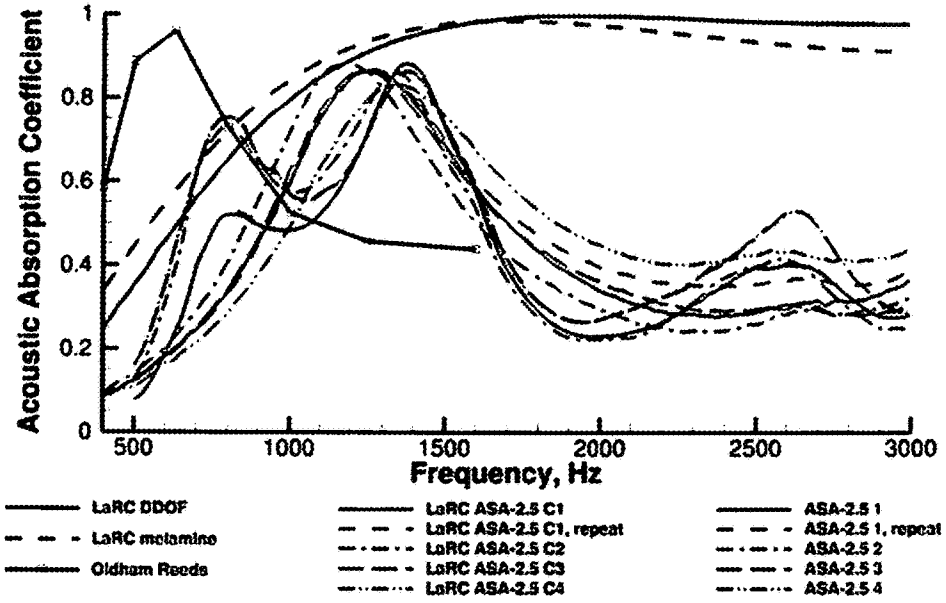
Figure 28A:
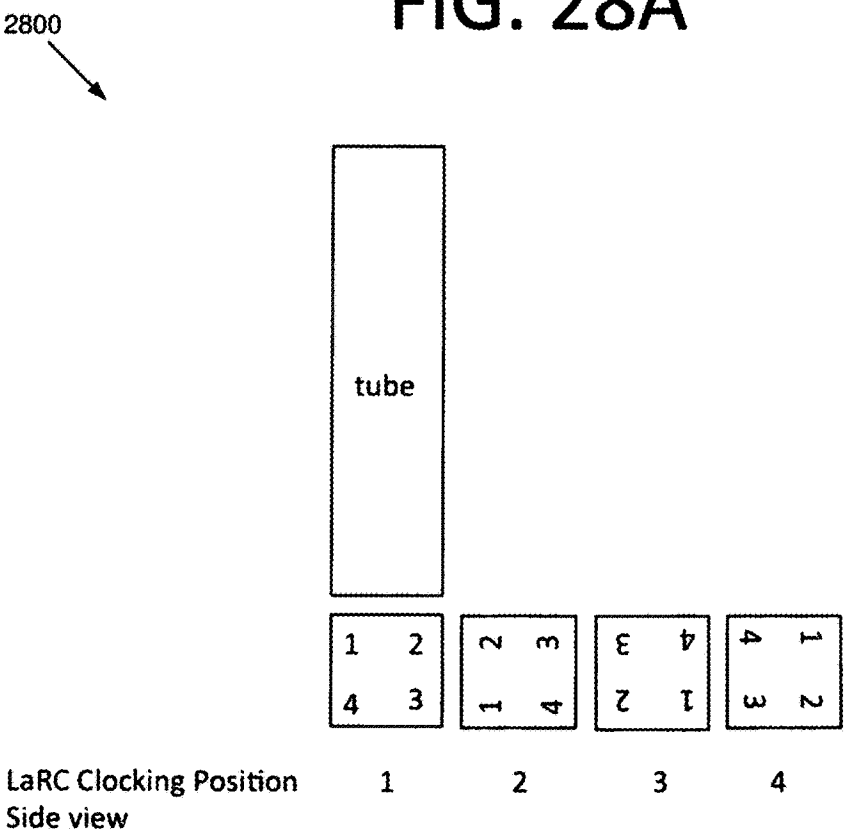
FIG. 28A is a position diagram illustrating clocking positions at NASA Langley Research Center, according to an embodiment of the present invention.
Figure 28B:
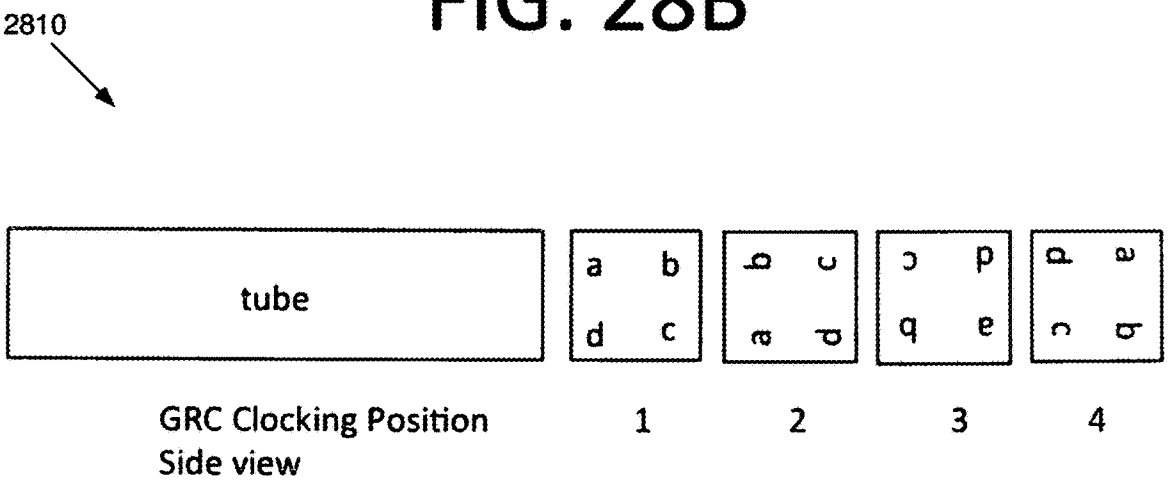
FIG. 28B is a position diagram illustrating clocking positions at NASA Glenn Research Center, according to an embodiment of the present invention.

The acoustic tests of ASA-2.1 demonstrated for the first time that the acoustic absorption coefficient for this "fixed" configuration was also greater than the baseline at frequencies below 800 Hz, as shown in graphs 1300 and 2200 of FIGS. 13 and 22, respectively. This finding might be of practical importance, as "fixed" configurations may be preferred to "loose" configurations for different industrial applications. The acoustic absorption coefficient for ASA-2.1 ranged between 0.6 and 0.9 for the majority of the tested frequency range, also indicating high acoustic absorption over a wide range of frequencies. Acoustic absorption of the samples with irregular distribution of pores was slightly dependent upon the "clocking" position, or the position of the heterogeneous sample relative to the incident sound wave, as shown in position diagrams 2800, 2810 of FIGS. 28A and 28B. The clocking position of the ASA-2.1 sample tested at GRC was not recorded. Again, this "fixed" configuration can be used in more controlled experiments to begin to understand the physics of the interaction between sound and these irregular structures.

Figure 14:
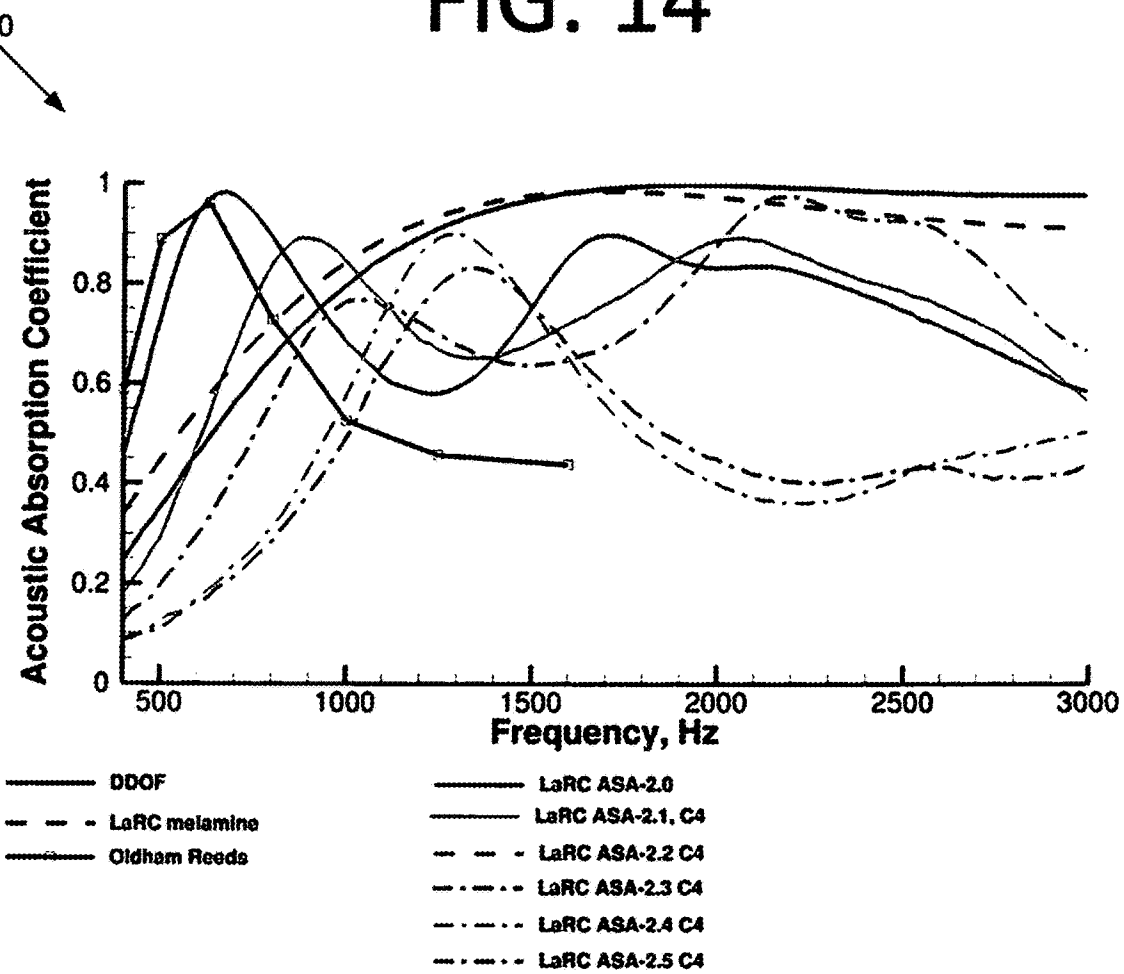
FIG. 14 is a graph illustrating a comparison of the baselines and the ASA samples tested at Langley with a broadband source providing 140 dB OASPL, according to an embodiment of the present invention.

Graph 1400 of FIG. 14 shows a comparison of the baselines and the all of the ASA samples tested at Langley. Only the ASA-2.0 and ASA-2.1 samples exceeded the acoustic performance of the baselines at frequencies below 1,000 Hz. Recall that samples ASA-2.4 and ASA-2.5 consisted of solid rods and not tubes. ASA-2.0 consisted of loosely packed tubes, where all the other ASA samples were "fixed" and did not need a retainer to hold its shape. The reasons for the significant differences between the samples are the subject of ongoing research.

Figure 15:
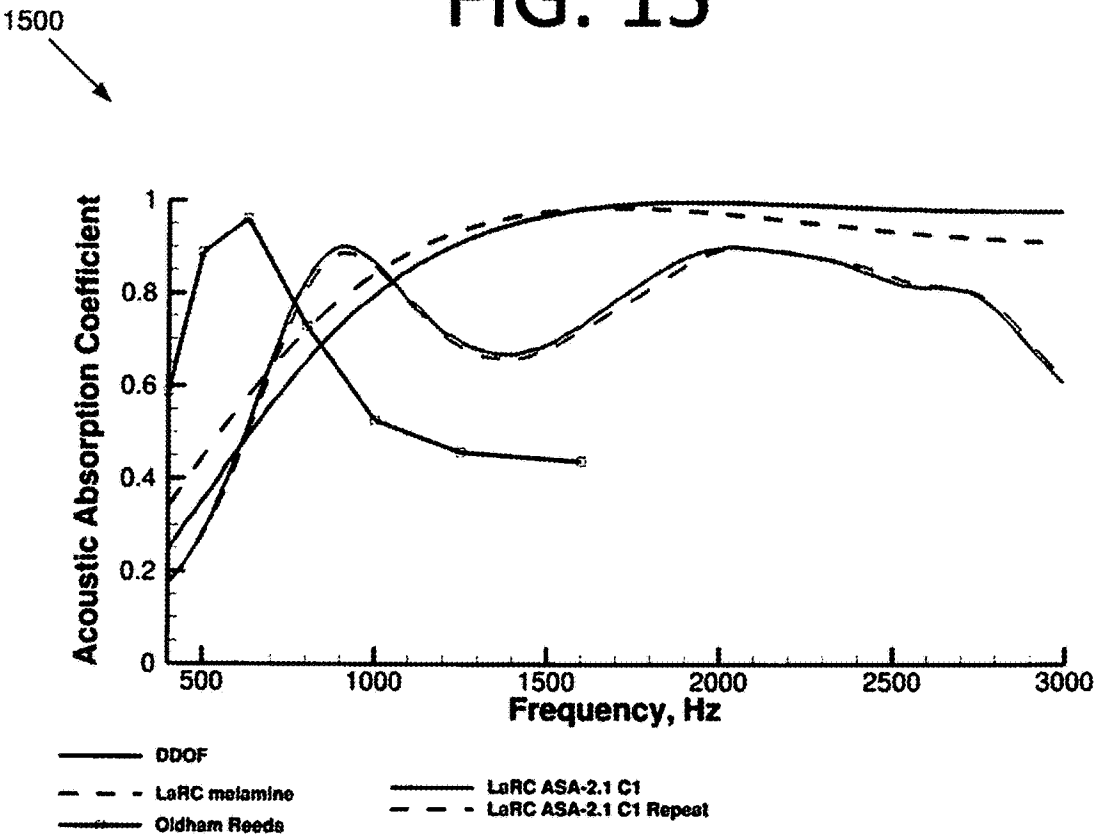
FIG. 15 is a graph illustrating repeated tests yielding similar results for the ASA samples tested at NASA Langley, as can be seen in the comparisons of the ASA 2.1 C1, with a broadband source providing 140 dB OASPL, according to an embodiment of the present invention.
Figure 16:
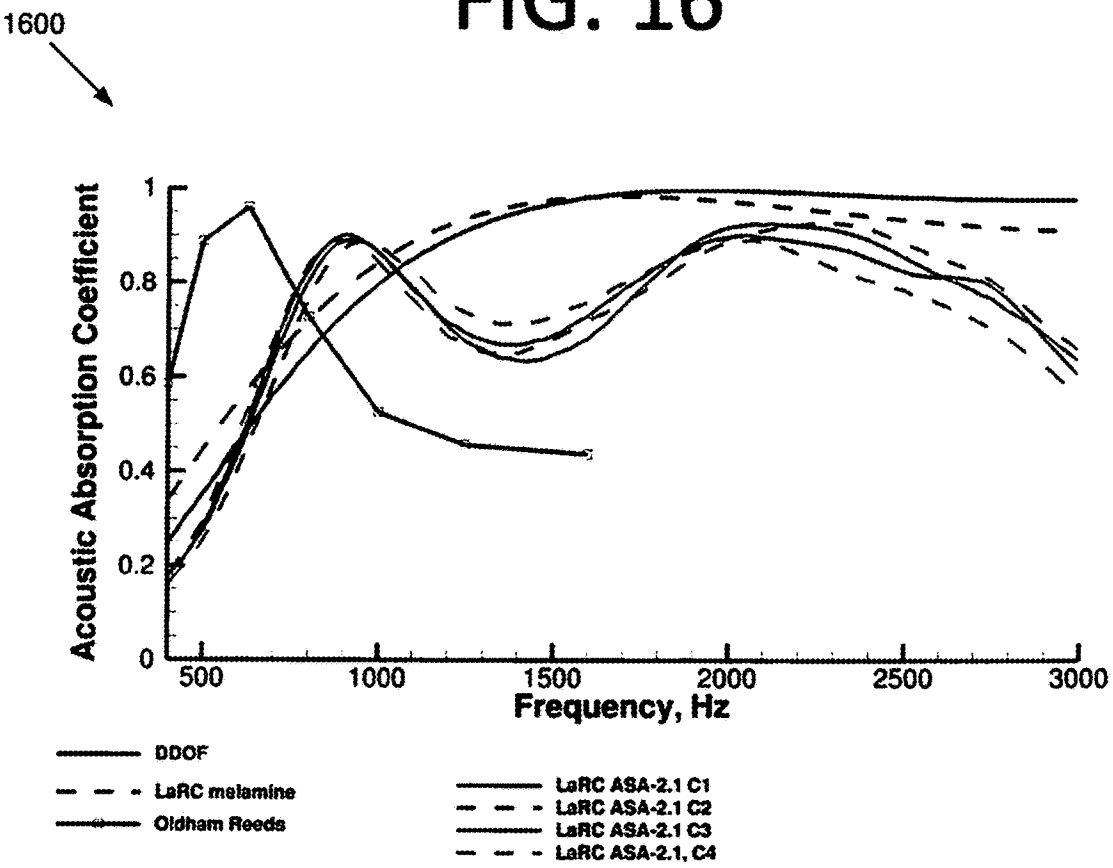
FIG. 16 is a graph illustrating acoustic absorption that depended slightly upon the clocking position for ASA 2.1 with a broadband source providing 140 dB OASPL, according to an embodiment of the present invention.
Figure 17:
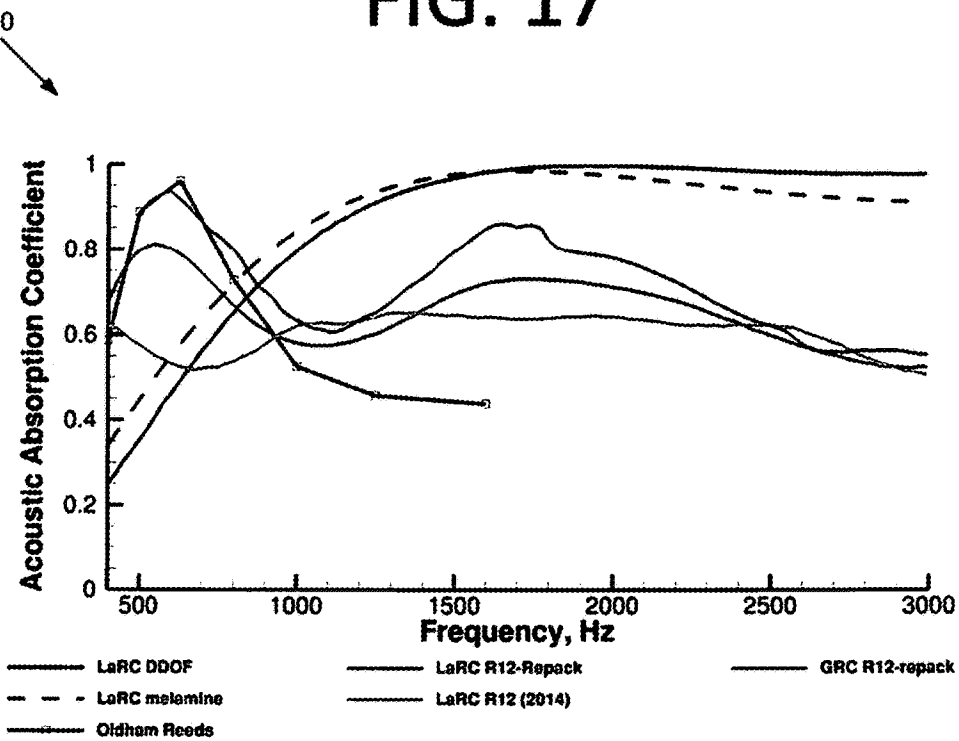
FIGS. 17-26 are graphs illustrating the acoustic absorption coefficient versus frequency for R12-repack, R-21 repack, R-22 repack, R-23 repack, and ASA-2.0 to 2.5, respectively, according to embodiments of the present invention.
Figure 18:
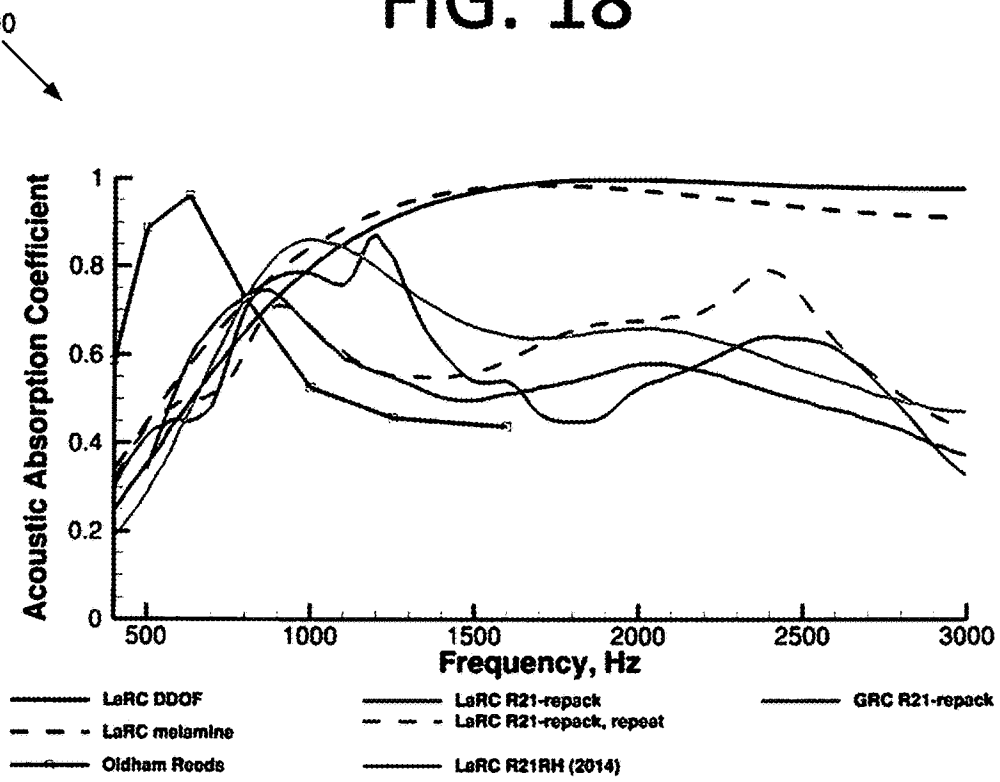
Figure 19:
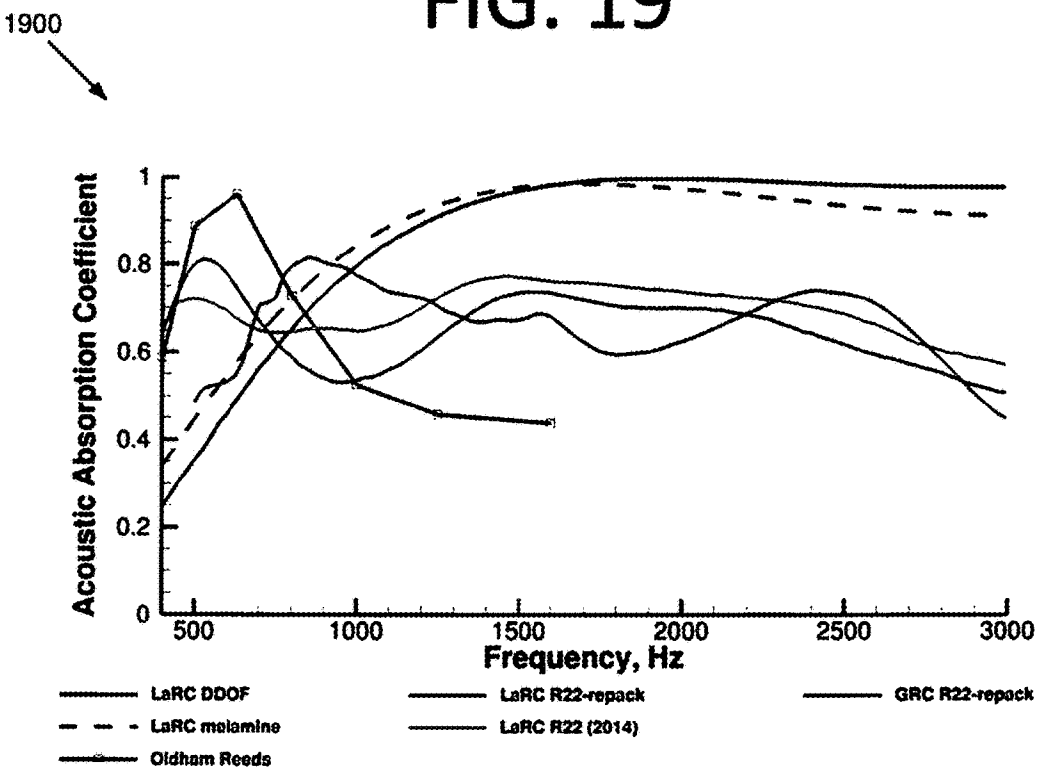
Figure 20:
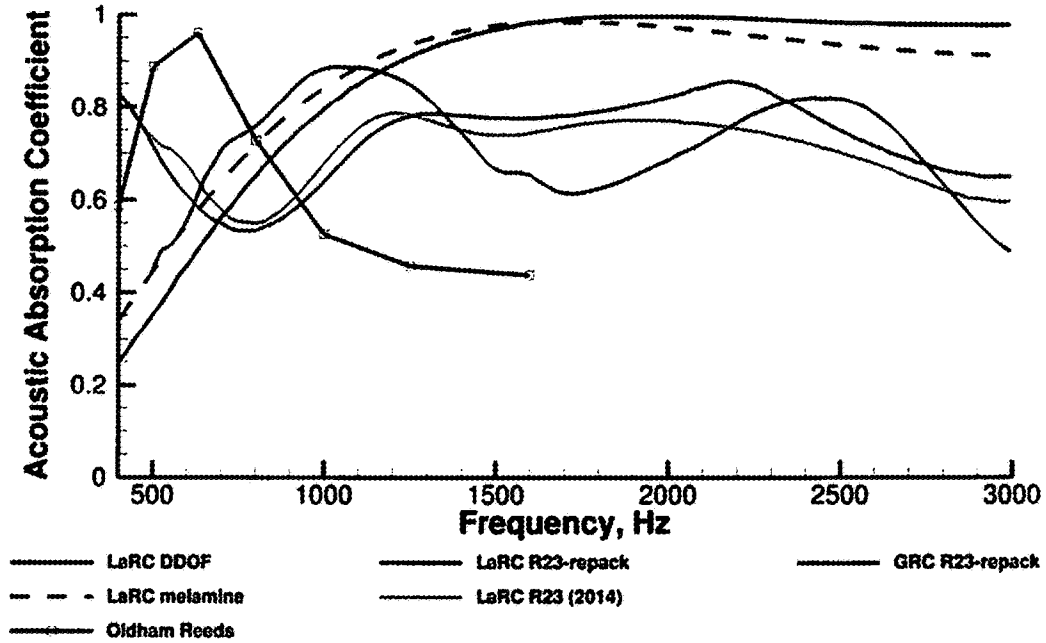
Figure 21:
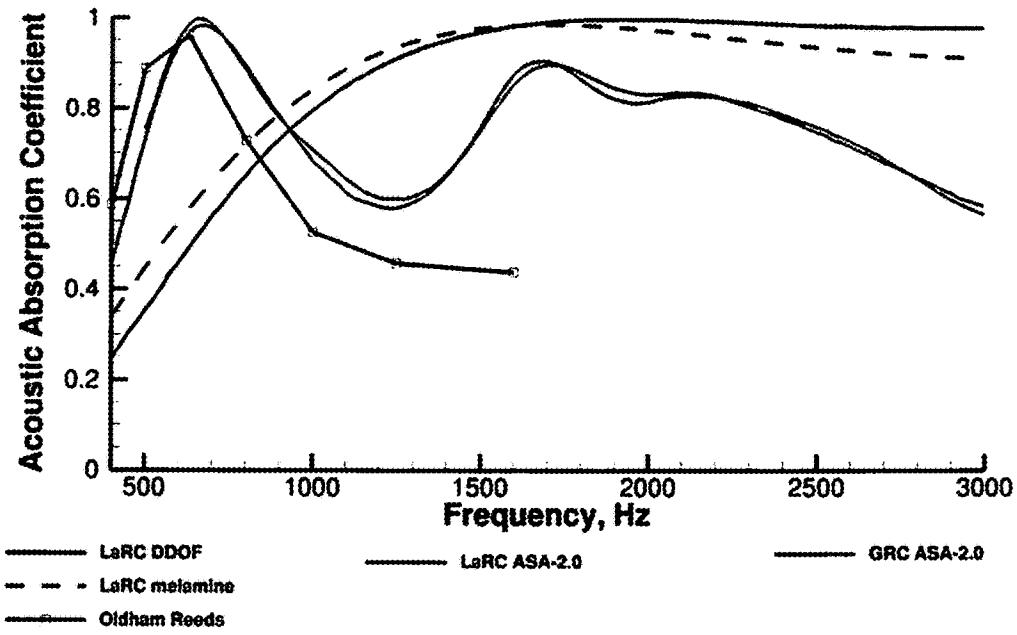

Repeated tests yielded similar results for the ASA samples tested at NASA Langley, as can be seen in graph 1500 of FIG. 15 for the comparisons of the ASA-2.1 in the C1 clocking position. There were differences, though, between the NASA Glenn and NASA Langley results for samples ASA-2.2, ASA-2.3, and ASA-2.5 as shown in graphs 2300, 2400, and 2600 of FIGS. 23,24, and 26, respectively. The cause of these differences is not known. Orientation of the sample might play a role. Recall that the NASA Langley tube is vertical and the NASA Glenn tube is horizontal. The reeds of the prototypes are cantilevered in the NASA Langley experiment, but not in the NASA Glenn experiment, where the baseplate was typically mounted on the bottom. Acoustic absorption depended slightly upon clocking position for ASA-2.1, graph 1600 of FIG. 16.

It will be readily understood that the components of various embodiments of the present invention, as generally described and illustrated in the figures herein, may be arranged and designed in a wide variety of different configurations. Thus, the detailed description of the embodiments, as represented in the attached figures, is not intended to limit the scope of the invention as claimed, but is merely representative of selected embodiments of the invention.

The features, structures, or characteristics of the invention described throughout this specification may be combined in any suitable manner in one or more embodiments. For example, reference throughout this specification to "certain embodiments," "some embodiments," or similar language means that a particular feature, structure, or characteristic described in connection with the embodiment is included in at least one embodiment of the present invention. Thus, appearances of the phrases "in certain embodiments," "in some embodiment," "in other embodiments," or similar language throughout this specification do not necessarily all refer to the same group of embodiments and the described features, structures, or characteristics may be combined in any suitable manner in one or more embodiments.

It should be noted that reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

One having ordinary skill in the art will readily understand that the invention as discussed above may be practiced with steps in a different order, and/or with hardware elements in configurations which are different than those which are disclosed. Therefore, although the invention has been described based upon these preferred embodiments, it would be apparent to those of skill in the art that certain modifications, variations, and alternative constructions would be apparent, while remaining within the spirit and scope of the invention. In order to determine the metes and bounds of the invention, therefore, reference should be made to the appended claims.

The invention claimed is:

1. An apparatus, comprising:

acoustic absorber panels located on a plurality of sides of a body to be acoustically dampened, wherein each acoustic absorber panel comprises:

at least one cubic retainer, wherein the cubic retainer is open to a surrounding gaseous environment and capable of receiving sound waves to be acoustically dampened, the cubic retainer comprising:

at least one solid side; and at least one perforated side permitting sound waves in the surrounding gaseous environment to enter the cubic retainer; and an acoustic absorber layer disposed within the cubic retainer and comprised of a plurality of reeds, wherein:

the plurality of reeds each comprise a first end, a second end, and a length disposed between the first end and the second end;

the plurality of reeds are natural reeds, synthetic reeds, or a combination of natural and synthetic reeds;

the plurality of reeds are fixed at one end, wherein the length of each of the reeds is substantially perpendicular to the sound waves entering the cubic retainer; and the plurality of reeds are each open on at least one end to the surrounding gaseous environment;

wherein sound waves entering the cubic retainer are acoustically dampened by the acoustic absorber layer.

2. The apparatus of claim 1, wherein acoustic absorber panels on at least one side of the body to be acoustically dampened differ from acoustic absorber panels on at least one other side of the body to be acoustically dampened.

3. The apparatus of claim 1, wherein the at least one perforated side of the cubic retainer further comprises:

a porous or perforated face sheet.

4. The apparatus of claim 1, wherein the reeds form a single layer in which individual reeds are parallel to one another.

5. The apparatus of claim 1, wherein the reeds form multiple layers or are arranged in one or more bundles.

6. The apparatus of claim 1, wherein at least two layers of reeds have different widths from one another.

7. The apparatus of claim 1, wherein the acoustic absorber layer comprises synthetic reeds having a hollow or porous structure.

8. The apparatus of claim 7, wherein the synthetic reeds are hollow, porous, bent, straight, of varying widths, have a "C" shaped cross-section, have a spiral cross section, or have a cross section shape that varies along a length of a reed.

9. The apparatus of claim 7, wherein at least some reeds of the synthetic reeds have a different shape than at least some other reeds of the synthetic reeds.

10. The apparatus of claim 1, wherein the acoustic absorber layer is configured to provide acoustic absorption between 0 and 3,000 Hz.

11. The apparatus of claim 1, wherein the acoustic absorber panel further comprises:

a porous or perforated face sheet as the at least one perforated side of the cubic retainer; and a porous, hydrophobic, and/or oleophobic membrane located between the acoustic absorber layer and the porous or perforated face sheet, or on an opposite side of the porous or perforated face sheet from the acoustic absorber layer.

12. The apparatus of claim 1, wherein the acoustic absorber panel further comprises a backing sheet, a bulk absorber, a screen, a porous, hydrophobic, and/or oleophobic membrane, or any combination thereof.

13. An acoustic absorber panel, comprising:

at least one cubic retainer, wherein the cubic retainer is open to a surrounding gaseous environment, the cubic retainer comprising:

at least one solid side; and at least one perforated side, wherein the at least one solid side is opposite the at least one perforated side; and an acoustic absorber layer disposed within the cubic retainer and comprised of a plurality of reeds, wherein:

the plurality of reeds each comprise a first end, a second end, and a length disposed between the first end and the second end;

the plurality of reeds are natural reeds, synthetic reeds, or a combination of natural and synthetic reeds;

the plurality of reeds are fixed on the first end to a side of the cubic retainer, wherein the length of each of the reeds is substantially perpendicular to the sound waves entering the cubic retainer; and the plurality of reeds are each open on at least one end to the surrounding gaseous environment, wherein sound may attenuate through the at least one open end.

14. The acoustic absorber panel of claim 13, wherein the acoustic absorber layer comprises synthetic reeds having a hollow or porous.

15. The acoustic absorber panel of claim 14, wherein the synthetic reeds have a tube shape, a "C" shape, a spiral shape, or any combination thereof.

16. The acoustic absorber panel of claim 14, wherein at least some reeds of the synthetic reeds have a different shape than at least some other reeds of the synthetic reeds.

17. A broadband acoustic absorber panel, comprising:

an acoustic absorber layer; and a porous, hydrophobic, and/or oleophobic membrane positioned on at least one side of the acoustic absorber layer, wherein the acoustic absorber layer comprises:

at least one cubic retainer, wherein the cubic retainer is open to a surrounding gaseous environment to receive sound waves to be acoustically dampened, the cubic retainer comprising:

at least one solid side; and at least one perforated side permitting sound waves in the surrounding gaseous environment to enter the cubic retainer; and a natural or synthetic bulk absorber, natural reeds, synthetic reeds, or any combination thereof.

18. The broadband acoustic absorber panel of claim 17, further comprising:

a backing sheet, a bulk absorber, a screen, a porous, hydrophobic, and/or oleophobic membrane, or any combination thereof.

* * * * *